US005385684A

United States Patent [19]

Gutierrez et al.

[11] Patent Number: 5,385,684

[45] Date of Patent: Jan. 31, 1995

[54] BRANCHED AMIDO-AMINE DISPERSANT ADDITIVES

[75] Inventors: Antonio Gutierrez, Mercerville; Robert D. Lundberg, Bridgewater, both of N.J.

[73] Assignee: Exxon Chemical Patents, Inc., Linden, N.J.

[21] Appl. No.: 92,184

[22] Filed: Jul. 15, 1993

Related U.S. Application Data

[60] Division of Ser. No. 926,129, Aug. 5, 1992, Pat. No. 5,229,020, which is a continuation of Ser. No. 358,903, May 30, 1989, abandoned.

[51] Int. Cl.[6] ..... C10M 149/12; C10M 151/04

[52] U.S. Cl. ..... 252/47.5; 252/51.5 A; 564/74; 564/153; 564/154; 564/155

[58] Field of Search ..... 252/51.5 A, 47.5

[56] References Cited

U.S. PATENT DOCUMENTS

| | | | |
|---|---|---|---|
| 2,921,085 | 10/1960 | Schramm | 260/458 |
| 3,247,163 | 4/1966 | Reinking | 260/47 |
| 3,337,609 | 8/1967 | Williamson et al. | 260/482 |
| 3,340,190 | 9/1967 | Deluga et al. | 252/33.4 |
| 3,385,791 | 5/1968 | Colyer et al. | 252/32.7 |
| 3,417,140 | 12/1968 | McWhorter et al. | 260/561 |
| 3,445,441 | 5/1969 | Rushton | 260/89.5 |
| 3,449,362 | 6/1969 | Lee | 260/326.3 |
| 3,491,025 | 1/1970 | Lee | 252/49.6 |
| 3,509,047 | 4/1970 | Rushton | 210/54 |
| 3,514,250 | 5/1970 | Rushton | 21/2.5 |
| 3,528,928 | 9/1970 | Rushton | 252/341 |
| 3,630,902 | 12/1971 | Coupland et al. | 252/51.5 A |
| 3,718,663 | 2/1973 | Piasek et al. | 260/326.3 |
| 3,873,460 | 3/1975 | Coon et al. | 252/51.5 A |
| 3,897,456 | 7/1975 | Brewster | 260/340.2 |
| 3,903,003 | 9/1975 | Murphy et al. | 252/51.5 A |
| 4,159,957 | 7/1979 | de Vries | 252/33.4 |
| 4,459,241 | 7/1984 | Wilson et al. | 260/502.5 E |
| 4,493,771 | 1/1985 | Wilson et al. | 210/700 |
| 4,507,466 | 3/1985 | Tomalia et al. | 528/332 |
| 4,547,562 | 10/1985 | Nichols | 528/119 |
| 4,558,120 | 12/1985 | Tomalia et al. | 528/363 |
| 4,587,329 | 5/1986 | Tomalia et al. | 528/363 |
| 4,675,374 | 6/1987 | Nichols | 528/119 |
| 4,713,189 | 12/1987 | Nalesnik | 252/51.5 A |
| 4,857,217 | 8/1989 | Gutierrez et al. | 252/47 |
| 4,933,098 | 6/1990 | Gutierrez et al. | 252/51.5 A |
| 4,938,885 | 7/1990 | Migdal | 252/51.5 A |
| 4,956,107 | 9/1990 | Gutierrez et al. | 252/51.5 A |
| 5,124,056 | 6/1992 | Gutierrez et al. | 252/51.5 A |
| 5,186,851 | 2/1993 | Gutierrez et al. | 252/51.5 A |
| 5,200,103 | 4/1993 | Song et al. | 252/51.5 A |
| 5,219,480 | 6/1993 | Gutierrez et al. | 252/51.5 A |
| 5,229,020 | 7/1993 | Gutierrez et al. | 252/51.5 A |
| 5,268,115 | 12/1993 | Gutierrez et al. | 252/51.5 A |

FOREIGN PATENT DOCUMENTS

| | | |
|---|---|---|
| 0301716 | 2/1989 | European Pat. Off. . |
| 0319229 | 6/1989 | European Pat. Off. . |
| 0356010 | 2/1990 | European Pat. Off. . |
| 2346442 | 10/1977 | France . |
| 1068133 | 5/1967 | United Kingdom . |
| 87-06228 | 10/1987 | WIPO . |

*Primary Examiner*—Ellen M. McAvoy

*Attorney, Agent, or Firm*—J. B. Murray, Jr.; K. R. Walton

[57] ABSTRACT

The present invention is directed to branched amidoamine additives useful in oleaginous compositions formed by (a) reacting a first nitrogen-containing compound (e.g., ammonia or an organic amine) with an alpha, betaunsaturated compound of the formula:

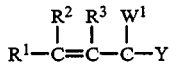

wherein $W^1$ is sulfur or oxygen, Y is $—OR^4$, $—SR^4$, or $—NR^4(R^5)$, and $R^1$, $R^2$, $R^3$, $R^4$ and $R^5$ are the same or different and are hydrogen or substituted or unsubstituted hydrocarbyl, to form a first adduct containing unreacted $—C(W^1)—Y$ groups; (b) reacting the first adduct with a polyamine (e.g., a polyalkylene polyamine) to form a second adduct containing unreacted —NH— group (preferably primary amine groups) and comprising a branched amido-amine oligomer; and (c) reacting the second adduct with mixtures of an aldehyde and a long chain hydrocarbyl substituted hydroxy aromatic compound.

35 Claims, No Drawings

BRANCHED AMIDO-AMINE DISPERSANT ADDITIVES

This is a division, of application Ser. No. 926,129, filed Aug. 5, 1992 now U.S. Pat. No. 5,229,020; which is a R62 continuation of U.S. Ser. No. 358,903, f. May 30, 1989, now abandoned.

FIELD OF THE INVENTION

This invention relates to improved oil soluble dispersant additives useful in fuel and lubricating compositions , and to concentrates containing said additives.

BACKGROUND OF THE INVENTION

U.S. Pat. No. 2,921,085 relates to the preparation of beta-aminopropionamides by reaction of an alkyl amine with an acrylate to form an alkyl aminopropionate and reaction of the latter compound with an amine. The resulting compounds are disclosed to have utility as surface active agents, specifically as emulsifying, wetting, foaming and detergent agents.

U.S. Pat. No. 3,337,609 relates to adducts of hydroxyalkyl alkylene polyamines and acrylates. The resulting adducts are added to polyepoxides to provide compositions which are suitable for use as a barrier coating for polyethylene surfaces, and for additional end uses, such as in molding. In addition, the adducts are disclosed to be useful as catalysts in resin preparation and as corrosion inhibitors in water systems for ferrous metals.

U.S. Pat. No. 3,417,140 relates to the preparation of amido-amine compositions, which are useful as epoxy resin curing agents, by reacting a polyalkylene polyamine and a fatty amine (comprising a mono- or diamine having as one of the substituents on a nitrogen atom a hydrocarbyl radical having 8 to 24 carbon atoms) with an alpha-beta unsaturated carbonylic compound. It is disclosed that this reaction occurs through the Michael addition of an amine group across the unsaturated group of the carbonylic compound and through the condensation of an amine group with the carbonylic group.

U.S. Pat. No. 3,247,163 also relates to curing agents for polyepoxide compositions, which curing agents are prepared by reacting an organic amine and an acrylate.

U.S. Pat. No. 3,445,441 relates to amino-amido polymers characterized by being a reaction product of at least a polyamine and an acrylate type compound, such as methyl or ethyl acrylate, and methyl or ethyl methacrylate. The patent states that the polymers are useful in a wide variety of applications, such as floculating agents, water clarifying additives, corrosion inhibitors in oil and gas wells, and as lube oil additives. The patent further discloses that the polymers may be derivitized, including acylation with monocarboxylic acids and polycarboxylic acids, aliphatic dicarboxylic acids, aromatic dicarboxylic acids, for example, diglycolic, phthalic, succinic, etc., acids.

U.S. Pat. No. 3,903,003 relates to lubricating compositions containing an amido-amine reaction product of a terminally carboxylated isoprene polymer which is formed by reacting a terminally carboxylated substantially completely hydrogenated polyisoprene having an average molecular weight between about 20,000 and 250,000 and a nitrogen compound of the group consisting of polyalkylene amines and hydroxyl polyalkylene amines.

U.S. Pat. No. 4,493,771 relates to scale inhibiting with compounds containing quaternary ammonium and methylene phosphonic acid groups. These compounds are derivatives of polyamines in which the amine hydrogens have been substituted with both methylene phosphonic acid groups or their salts and hydroxypropyl quaternary ammonium halide groups. The patent discloses that any amine that contains reactive amino hydrogens can be utilized, for example, polyglycol amines, amido-amines, oxyacylated amines, and others.

U.S. Pat. No. 4,459,241 contains a similar disclosure to U.S. Pat. No. 4,493,771.

SUMMARY OF THE INVENTION

A process for forming a nitrogen-containing lubricating oil dispersant additive which comprises: (a) contacting in a first liquid reaction mixture a first nitrogen-containing compound having at least two reactive nitrogen moieties with a polyfunctional reactant having within its structure a first functional group reactive with a —NH— group, and at least one additional functional group reactive with a —NH— group, in an amount and under conditions sufficient to selectively react the first functional groups in the polyfunctional reactant with the reactive nitrogen moieties to form a first reaction mixture containing a first adduct; (b) contacting the first adduct with a second nitrogen-containing compound having at least two —NH— groups in an amount and under conditions sufficient to react the additional functional groups in the first adduct with said —NH— groups in the second nitrogen-containing compound to form a second adduct characterized by having within its structure on average (i) at least two nitrogen-containing moieties derived from the second nitrogen-containing compound per nitrogen-containing moiety derived from the first nitrogen-containing compound and (ii) at least two unreacted primary or secondary amine groups per molecule; and (c) contacting the second adduct in a second liquid reaction mixture with at least one long chain hydrocarbon-substituted reactant in an amount and under conditions sufficient to form the nitrogen-containing dispersant, said long chain hydrocarbon-substituted reactant comprising at least one member selected from the group consisting of;

(A) long chain hydrocarbons substituted with mono- or dicarboxylic acid, anhydride or ester groups;

(B) halogenated long chain hydrocarbons;

(C) mixtures of formaldehyde and a long chain hydrocarbyl substituted phenol; and (D) mixtures of formaldehyde and a reaction product formed by reaction of long chain hydrocarbons substituted with mono- or dicarboxylic acid, anhydride or ester groups and an amino-substituted, optionally hydrocarbyl-substituted phenol.

In one preferred embodiment, the present invention is directed to a branched amido-amine dispersant additive, and more preferably to a star branched amido-amine dispersant additive, useful in oleaginous compositions formed by (a) reacting a first nitrogen- containing compound (e.g., ammonia or an organic amine) with an alpha, beta-unsaturated compound of the formula:

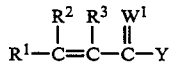

wherein $W^1$ is sulfur or oxygen, Y is $—OR^4$, $—SR^4$, or $—NR^4(R^5)$, and $R^1$, $R^2$, $R^3$, $R^4$ and $R^5$ are the same or different and are hydrogen or substituted or unsubstituted hydrocarbyl, to form a first adduct containing unreacted —C(W1)—Y groups; (b) reacting the first adduct with a polyamine (e.g., a polyalkylene polyamine) to form a second adduct containing unreacted —NH— groups (preferably primary amine groups) and comprising a branched amido-amine oligomer; and (c) reacting said second adduct with a long chain hydrocarbyl substituted mono- or dicarboxylic acid material comprising a polyolefin of 300 to 10,000 number average molecular weight substituted with at least 0.3 (e.g., from about 1 to 4) mono- or dicarboxylic acid producing moieties (preferably acid or anhydride moieties) per polyolefin molecule.

The materials of the invention are different from the prior art because of their effectiveness and their ability to provide enhanced dispersancy. In fuels, the additives serve to minimize the degree of carburetor and fuel injector fouling from deposits. In addition, the additives of this invention possess superior viscometric properties.

Therefore, the present invention is also directed to novel processes for preparing the dispersant fuel adducts of this invention.

DETAILED DESCRIPTION OF THE INVENTION

FIRST NITROGEN-CONTAINING COMPOUND

As described above, the first adduct employed in the present invention is prepared by contacting a polyfunctional reactant with a first nitrogen-containing compound containing at least two (e.g., from 2 to 20), preferably at least 3 (e.g., from 3 to 15), and most preferably from 3 to 8, reactive nitrogen moieties (that is, the total of the nitrogen-bonded H atoms) per molecule of the first nitrogen-containing compound. The first nitrogen-containing compound will generally comprise at least one member selected from the group consisting of ammonia, organic primary monoamines and organic polyamines containing at least one primary amine group or at least two secondary amine groups per molecule. Generally, the organic amines will contain from about 2 to 60, preferably 2 to 40 (e.g. 3 to 20), total carbon atoms and about 2 to 12, preferably 3 to 12, and most preferably from 3 to 8 (e.g., 5 to 9) total nitrogen atoms in the molecule. These amines may be hydrocarbyl amines or may be hydrocarbyl amines including other groups, e.g., hydroxy groups, alkoxy groups, amide groups, nitriles, imidazoline groups, and the like. Hydroxy amines with 1 to 6 hydroxy groups, preferably 1 to 3 hydroxy groups are particularly useful. Preferred amines are aliphatic saturated amines, including those of the general formulas:

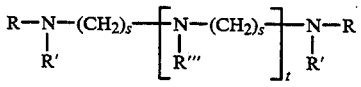

wherein R, R', R'' and R''' are independently selected from the group consisting of hydrogen; $C_1$ to $C_{25}$ straight or branched chain alkyl radicals; $C_1$ to $C_{12}$ alkoxy $C_2$ to $C_6$ alkylene radicals; $C_2$ to $C_{12}$ hydroxy amino alkylene radicals; and $C_1$ to $C_{12}$ alkylamino $C_2$ to $C_6$ alkylene radicals; and wherein R''' can additionally comprise a moiety of the formula:

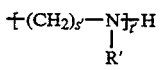

(III)

wherein R' is as defined above, and wherein s and s' can be the same or a different number of from 2 to 6, preferably 2 to 4; and t and t' can be the same or different and are numbers of from 0 to 10, preferably 2 to 7, and most preferably about 3 to 7, with the proviso that the sum of t and t' is not greater than 15. To assure a facile reaction, it is preferred that R, R', R'', R''', s, s', t and t' be selected in a manner sufficient to provide the compounds of Formulas I and II with typically at least one primary or secondary amine group, preferably at least two primary or secondary amine groups. This can be achieved by selecting at least one of said R, R', R'' or R''' groups to be hydrogen or by letting t in Formula II be at least one when R''' is H or when the III moiety possesses a secondary amino group.

Non-limiting examples of suitable organic amine compounds include: 1,2-diaminoethane; 1,3-diaminopropane; 1,4-diaminobutane; 1,6-diaminohexane; polyethylene amines such as diethylene triamine; triethylene tetraamine; tetraethylene pentamine; polypropylene amines such as 1,2 -propylene diamine; di- (1,2-propylene) triamine; di- (1,3-propylene) triamine; N,N-dimethyl-1,3-diaminopropane; N,N-di-(2-aminoethyl) ethylene diamine; N,N-di(2-hydroxyethyl) -1,3-propylene diamine; 3-dodecyloxypropylamine; N-dodecyl-1,3-propane diamine; tris hydroxymethylaminomethane (THAM); diisopropanol amine; diethanoi amine; triethanol amine; mono-, di-, and tri-tallow amines; amino morpholines such as N-(3-aminopropyl) morpholine; and mixtures thereof.

Other useful amine compounds include: alicyclic diamines such as 1,4-di(aminomethyl)cyclohexane, and heterocyclic nitrogen compounds such as imidazolines, and N-aminoalkyl piperazines of the general formula (IV):

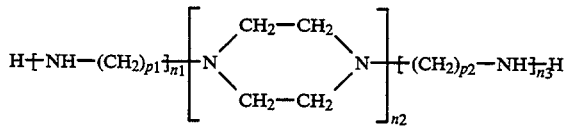

wherein $P_1$ and $P_2$ are the same or different and are each integers of from 1 to 4, and $n_1$, $n_2$ and $n_3$ are the same or different and are each integers of from 1 to 3. Non-limiting examples of such amines include 2-pentadecyl imidazoline: N-(2-aminoethyl) piperazine; etc.

Commercial mixtures of amine compounds may advantageously be used. For example, one process for preparing alkylene amines involves the reaction of an involves the reaction of an alkylene dihalide (such as ethylene dichloride or propylene dichloride) with ammonia, which results in a complex mixture of alkylene amines wherein pairs of nitrogens are joined by alkylene groups, forming such compounds as diethylene triamine, triethylenetetraamine, tetraethylene pentamine and isomeric piperazines. Low cost poly(ethyleneamines) compounds averaging about 5 to 7 nitrogen atoms per molecule are available commercially under trade names such as "Polyamine H", "Polyamine 400", "Dow Polyamine E-100", etc.

Useful amines also include polyoxyalkylene polyamines such as those of the formulae:

$$NH_2\text{—alkylene}\left(\text{O-alkylene}\right)_m NH_2 \quad \text{(V)}$$

where m has a value of about 3 to 70 and preferably 10 to 35; and $$R\left(\text{alkylene}\left(\text{O-alkylene}\right)_n NH_2\right)_p \quad \text{(VI)}$$

where "n" has a value of about 1 to 40 with the provision that the sum of all the n's is from about 3 to about 70 and preferably from about 6 to about 35, and R is a polyvalent saturated hydrocarbon radical of up to ten carbon atoms wherein the number of substituents on the R group is represented by the value of "p", which is a number of from 3 to 6. The alkylene groups in either formula (V) or (VI) may be straight or branched chains, containing about 2 to 7, and preferably about 2 to 4 carbon atoms.

The polyoxyalkylene polyamines of formulas (V) or (VI) above, preferably polyoxyalkylene diamines and polyoxyalkylene triamines, may have average molecular weights ranging from about 200 to about 4000 and preferably from about 400 to about 2000. The preferred polyoxyalkylene polyoxyalkylene polyamines include the polyoxyethylene and polyoxypropylene diamines and the polyoxypropylene triamines having average molecular weights ranging from about 200 to 2000. The polyoxyalkylene polyamines are commercially available and may be obtained, for example, from the Jefferson Chemical Company, Inc. under the trade name "Jeffamines D-230, D-400, D-1000, D-2000, T-403", etc.

Additional amines useful in the present invention are described in U.S. Pat. No. 3,445,441, the disclosure of which is hereby incorporated by reference in its entirety.

Most preferred as the first nitrogen-containing compound are members selected from the group consisting of ammonia and organic diprimary amines having from 2 to 12 carbon atoms and from 2 to 8 nitrogen atoms per molecule. Examples of such preferred organic diprimary amines are ethylene diamine, propylene diamine, diethylene triamine, dipropylene triamine, triethylene tetraamine, tripropylene tetraamine, tetraethylene pentaamine, tetrapropylene pentaamine, polyhexamethylene diamine, phenyl diamine.

POLYFUNCTIONAL REACTANT

Polyfunctional reactants useful in this invention include compounds having the formula (VII):

$$X-\overset{\overset{W^1}{\|}}{C}-(T)_a-[\overset{\overset{W^2}{\|}}{(C)}_b-Y]_c$$

wherein $W^1$ and $W^2$ are the same or different and are O or S, X and Y are the same or different, and preferably are each groups reactive with a —NH— group (i.e., with $NH_3$ or with primary or secondary amine groups), T is a substituted or unsubstituted hydrocarbon moiety, "a" is 0 or 1, "b" is 0 or 1, and "c" is an integer of at least 1, with the provisos that c=1 when a=0 and b=1 when a=1 , and with the further proviso that at least two of X, Y and T are reactive with a —NH— group.

The X and Y functional groups are the same or different and include groups selected from the group consisting of: halide, $—OR^4$, $—SR^4$, $—N(R^4)(R^5)$, $—Z^1-C(O)OR^4$, $—C(O)R^4$, $—(R^3)C{=}C(R^1)(R^2)$, $—Z^1$-nitrile, $—Z^1$-cyano, $—Z^1$-thiocyano, $—Z^1$-isothiocyano, and $—Z^1$-isocyano, wherein $R^1$, $R^2$, $R^3$, $R^4$ and $R^5$ are the same or different and are H or substituted or unsubstituted hydrocarbyl and wherein $Z^1$ is $C_1$ to $C_{20}$ (preferably $C^1$ to $C^{10}$) bivalent hydrocarbylene (preferably alkylene or arylene). If a=b =1, and T contains at least one >C=C< group, X and Y can together further comprise —O— or —S—, to provide as reactants a class of ethylenically unsaturated and aromatic anhydrides and sulfo-anhydrides. Preferably the X and Y groups in the selected polyfunctional reactant are different, and the reactivity of the X moiety with —NH— groups, under the selected reaction conditions, is greater than the reactivity of the Y moieties with such —NH— groups to permit a substantially selective reaction of the X groups with the first nitrogen-containing compound as described below. The relative reactivity of these groups on a polyfunctional reactant can be readily determined by conventional methods.

When $R^1$, $R^2$, $R^3$, $R^4$ or $R^5$ are hydrocarbyl, these groups can comprise alkyl, cycloalkyl, aryl, alkaryl, aralkyl or heterocyclic, which can be substituted with groups which are substantially inert to any component of the reaction mixture under conditions selected for preparation of the amido-amine. Such substituent groups include hydroxy, halide (e.g., Cl, Fl, I, Br), —SH and alkylthio. When one or more of $R^1$ through $R^5$ are alkyl, such alkyl groups can be straight or branched chain, and will generally contain from 1 to 20, more usually from 1 to 10, and preferably from 1 to 4, carbon atoms. Illustrative of such alkyl groups are methyl, ethyl, propyl, butyl, pentyl, hexyl, heptyl, octyl, nonyl, decyl, dodecyl, tridecyl, hexadecyl, octadecyl and the like. When one or more of $R^1$ through $R^5$ are aryl, the aryl group will generally contain from 6 to 10 carbon atoms (e.g., phenyl, naphthyl).

When one or more of $R^1$ through $R^5$ are alkaryl, the alkaryl group will generally contain from about 7 to 20 carbon atoms, and preferably from 7 to 12 carbon atoms illustrative of such alkaryl groups are tolyl, m-ethylphenyl, o-ethyltolyl, and m-hexyltolyl. When one or more of $R^1$ through $R^5$ are aralkyl, the aryl component generally consists of phenyl or ($C_1$ to $C_6$) alkyl-substituted phenol and the alkyl component generally contains from 1 to 12 carbon atoms, and preferably from 1 to 6 carbon atoms. Examples of such aralkyl groups are benzyl, o-ethylbenzyl, and 4-isobutylbenzyl. When one or more of $R^1$ and $R^5$ are cycloalkyl, the cycloalkyl group will generally contain from 3 to 12 carbon atoms, and preferably from 3 to 6 carbon atoms. Illustrative of such cycloalkyl groups are cyclopropyl, cyclobutyl, cyclohexyl, cyclooctyl, and cyclododecyl. When one or more of $R^1$ through $R^5$ are heterocyclic, the heterocyclic group generally consists of a compound having at least one ring of 6 to 12 members in which one or more ring carbon atoms is replaced by oxygen or nitrogen. Examples of such heterocyclic groups are furyl, pyranyl, pyridyl, piperidyl, dioxanyl, tetrahydrofuryl, pyrazinyl and 1,4-oxazinyl.

T is a polyvalent organic radical whose valence is equal to c+1, wherein "c" is an integer of at least 1, preferably 1 to 3. Ordinarily T will not contain more than 20 carbon atoms and preferably not more than 10 carbon atoms. T can therefore include divalent groups such as as saturated and unsaturated hydrocarbylene (e.g., alkylene, alkenylene, arylene, and the like). When T is substituted, it can contain one or more substituents selected from the class consisting of halo, lower alkoxy, lower alkyl mercapto, nitro, lower alkyl, carboxy and oxo. It also may contain interrupting groups such as —O—, —S—, —S(O)—, —$S(O)_2$—, —NH—, —C(O)— and the like.

Exemplary of $Z^1$ groups are $C^1$ to $C^{10}$ branched and straight chained alkylene such as —$(CH_2)_f$— wherein "f" is an integer of from 1 to 10 (e.g., —$CH_2$—, —$C_2H_4$—, —$C_3H_7$—, —$C_4H_8$—, —$C_5H_{10}$—, and the like), and $C_6$ to $C_{20}$ arylene, and alkyl-substituted arylene such as —Ar—, —Ar—$((CH_2)_f)$—, —$((CH_2)_f)$—Ar—, —Ar—$((CH_2)_f)$ —Ar— and the like, wherein Ar is phenylene, methylphenylene, naphthylene, methylnaphthylene and the like and wherein f is as defined above.

Examples of polyfunctional reactants of formula VII wherein X is $(R^1)$ $(R^2)$ C=C$(R^3)$—, a=b=0 and c=1 are difunctional reactants comprising alpha, beta-ethylenically unsaturated compounds selected from the group consisting of compounds of the formula:

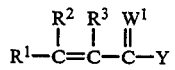

(VIII)

wherein $W^1$ is sulfur or oxygen, Y is as defined above, and is preferably —$OR^4$, —$SR^4$, or —$NR^4(R^5)$, wherein $R^1$, $R^2$, $R^3$, $R^4$ and $R^5$ are as defined above.

The alpha , beta-ethylenically unsaturated carboxylate compounds employed herein have the following formula:

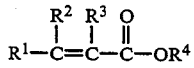

(IX)

wherein $R^1$, $R^2$, $R^3$, and $R^4$ are the same or different and are hydrogen or substituted or unsubstituted hydrocarbyl as defined above. Examples of such alpha, beta-ethylenically unsaturated carboxylate compounds of formula IX are acrylic acid, methacrylic acid, the methyl, ethyl, isopropyl, n-butyl, and isobutyl esters of acrylic and methacrylic acids, 2-butenoic acid, 2-hexenoic acid, 2-decenoic acid, 3-methyl-2-heptenoic acid, 3-methyl-2-butenoic acid, 3-phenyl-2-propenoic acid, 3-cyclohexyl-2-butenoic acid, 2-methyl-2-butenoic acid, 2-propyl-2-propenoic acid, 2-isopropyl-2-hexenoic acid, 2,3-dimethyl -2-butenoic acid, 3-cyclohexyl-2-methyl-2-pentenoic acid, 2-propenoic acid, methyl 2-propenoate, methyl 2-methyl 2-propenoate, methyl 2-butenoate, ethyl 2-hexenoate, isopropyl 2-decenoate, phenyl 2-pentenoate, tertiary butyl 2-propenoate, octadecyl 2-propenoate, dodecyl 2 -decenoate, cyclopropyl 2,3-dimethyl-2-butenoate, methyl 3-phenyl-2-propenoate, and the like.

The alpha, beta-ethylenically unsaturated reactants of formula IX wherein —$OR^4$ is instead —$R^4$ are aldehydes and ketones of the formula:

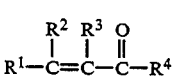

(IXa)

wherein $R^1$, $R^2$, $R^3$, $R^4$ and are the same or different and are hydrogen or substituted or unsubstituted hydrocarbyl as defined above. Examples of such alpha, beta-ethylenically unsaturated aldehydes and ketones of formula IXa are:

$H_2C$=CH—C(O)—$CH_3$
$H_2C$=CH—C(O)—$C_2H_5$
$H_2C$=CH—C(O)—$C_3H_7$
$H_2C$=CH—C(O)—C$(CH_3)_3$
$H_2C$=CH—C(O)—C$C_5H_{11}$
$H_2C$=C$(CH_3)$—C(O)—CH$(CH_3)_2$
$H_2C$=$(CH_3)$—C(O)—$C_2H_5$
H$(CH_3)$C=CH—C(O)—$CH_3$
H$(CH_3)$C=CH—C(O)—CH$(H_3)_2$
H$(CH_3)$C=CH—C(O)—$C_2H_5$
H$(CH_3)$C=CH—C(O)—$C_3H_7$
H$(C_2H_5)$C=CH—C(O)—C$(CH_3)_3$
H$(CH_3)$C=CH—C(O)—$C_5H_{11}$
$(CH_3)(C_2H_5)$C=C$(CH_3)$—C(O)—$CH_3$
H$(CH_3)$C=C$(CH_3)$—C(O)—$C_2H_5$

The alpha, bet a-ethylenically unsaturated carboxylate thioester compounds employed herein have the following formula:

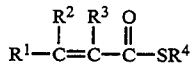

(X)

wherein $R^1$, $R^2$, $R^3$, $R^4$ are and the same or different and are hydrogen or substituted or unsubstituted hydrocarbyl as defined above. Examples of such alpha, beta-ethylenically unsaturated carboxylate thioesters of formula X are methylmercapto 2-butenoate, ethylmercapto 2-hexenoate, isopropylmercapto 2-decenoate, phenylmercapto 2-pentenoate, tertiary butylmercapto 2-propenoate, octadecylmercapto 2-propenoate, dodecylmercapto 2-decenoate, cyclopropylmercapto 2,3-dimethyl-2-butenoate, methylmercapto 3-phenyl -2-propenoate, methylmercapto 2-propenoate, methylmercapto 2-methyl-2 -propenoate, and the like.

The alpha, beta-ethylenically unsaturated carboxyamide compounds employed herein have the following formula:

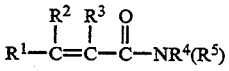

(XI)

wherein $R^1$, $R^2$, $R^3$, $R^4$ and $R^5$ are the same or different and are hydrogen or substituted or unsubstituted hydrocarbyl as defined above. Examples of alpha, beta-ethylenically unsaturated carboxyamides of formula XI are 2-butenamide, 2-hexenamide, 2-decenamide, 3-methyl-2-heptenamide, 3-methyl-2-butenamide, 3-phenyl -2-propenamide, 3-cyclohexyl-2-butenamide, 2-methyl-2-butenamide , 2 -propyl -2-propenamide, 2-isopropyl-2-hexenamide, 2,3-dimethyl-2 -butenamide, 3-cyclohexyl-2-methyl-2-pentenamide, N-methyl 2-butenamide, N, N-diethyl 2-hexenamide, N-isopropyl 2-decenamide, N-phenyl 2-pentenamide, N-tertiary butyl 2-propenamide, N-octadecyl 2-propenamide, N,N-didodecyl 2-decenamide, N-cyclopropyl 2,3-dimethyl-2-butenamide, N-methyl 3-phenyl-2-propenamide, 2-propenamide, 2-methyl-2-propenamide, 2-ethyl-2-propenamide and the like.

The alpha, beta-ethylenically unsaturated thiocarboxylate compounds employed herein have the following formula:

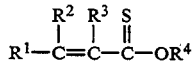

(XII)

wherein $R^1$, $R^2$, $R^3$ and $R^4$ are the same or different and are hydrogen or substituted or unsubstituted hydrocarbyl as defined above. Examples of alpha, beta-ethylenicaily unsaturated thiocarboxylate compounds of formula XII are 2-butenthioic acid, 2-hexenthioic acid, 2-decenthioic acid, 3-methyl-2-heptenthioic acid, 3-methyl-2-butenthioic acid, 3-phenyl-2-propenthioic acid, 3-cyclohexyl-2-butenthioic acid, 2-methyl-2-butenthioic acid, 2-propyl-2-propenthioic acid, 2-isopropyl-2-hexenthioic acid, 2,3-dimethyl-2-butenthioic acid, 3-cyclo-hexyl-2-methyl-2-pententhioic acid, 2-propenthioic acid, methyl 2-propenthioate, methyl 2-methyl 2-propenthioate, methyl 2-butenthioate, ethyl 2-hexenthioate, isopropyl 2-decenthioate, phenyl 2-pentenathioate, tertiary butyl 2-propenthioate, octadecyl 2-propenthioate, dodecyl 2-decenthioate, cyclopropyl 2,3 -dimethyl-2-butenthioate, methyl 3-phenyl-2-propenthioate, and the like.

The alpha, beta-ethylenically unsaturated dithioic acid and acid ester compounds employed herein have the following formula:

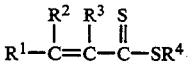

(XIII)

wherein $R^1$, $R^2$, $R^3$, and $R^4$ are the same or different and are hydrogen or substituted or unsubstituted hydrocarbyl as defined above. Examples of alpha, beta-ethylenically unsaturated dithioic acids and acid esters of formula XIII are 2-butendithioic acid, 2-hexendithioic acid, 2-decendithioic acid, 3-methyl-2-heptendithioic acid, 3-methyl-2-butendithioic acid, 3-phenyl-2-propendithioic acid, 3-cyclohexyl-2-butendithioic acid, 2-methyl-2-butendithioic acid, 2-propyl-2propendithioic acid, 2-isopropyl-2-hexendithioic acid, 2,3-dimethyl-2-butendithioic acid, 3-cyclohexyl-2-methyl-2-pentendithioic acid, 2-propendithioic acid, methyl 2-propendithioate, methyl 2-methyl 2-propendithioate, methyl 2-butendithioate, ethyl 2-hexendithioate, isopropyl 2-decendithioate, phenyl 2-pentendithioate, tertiary butyl 2-propendithioate, octadecyl 2-propendithioate, dodecyl 2-decendithioate, cyclopropyl 2,3-dimethyl-2-butendithioate, methyl 3-phenyl-2-propendithioate, and the like.

The alpha, beta-ethylenically unsaturated thiocarboxyamide compounds employed herein have the following formula:

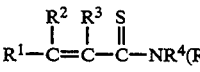

(XIV)

wherein $R^1$, $R^2$, $R^3$, $R^4$ and $R^5$ are the same or different and are hydrogen or substituted or unsubstituted hydrocarbyl as defined above. Examples of alpha, beta-ethylenically unsaturated thiocarboxyamides of formula XIV are 2 -butenthioamide, 2-hexenthioamide, 2-decenthioamide, 3-methyl-2-heptenthioamide, 3-methyl-2-butenthioamide, 3-phenyl-2-propenthioamide, 3-cyclohexyl-2-butenthioamide, 2-methyl-2-butenthioamide, 2-propyl-2-propenthioamide, 2-isopropyl-2-hexenthioamide, 2,3-dimethyl-2 -butenthioamide, 3-cyclohexyl-2-methyl-2-pententhioamide, N-methyl 2-butenthioamide, N,N-diethyl 2-hexenthioamide, N-isopropyl 2-decenthioamide, N-phenyl 2-pententhioamide, N-tertiary butyl 2-propenthioamide, N-octadecyl 2-propenthioamide, N,N-didodecyl 2-decenthioamide, N-cyclopropyl 2,3-dimethyl-2-butenthioamide, N-methyl 3-phenyl-2-propenthioamide, 2-propenthioamide, 2-methyl-2-propenthioamide, 2-ethyl-2-propenthioamide and the like.

Exemplary of polyfunctional reactants of formula VII wherein a=b=c=1 are compounds of the formula (xv):

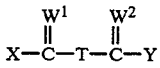

wherein $W^1$, $W^2$, X, Y and T are as defined above and wherein X and Y are different. Preferred members of this class of reactants are compounds of the formula (XVI):

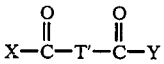

wherein X and Y are as defined above, wherein X and Y are different and wherein T' is substituted or unsubstituted divalent $C_1$ to $C_{20}$ (preferably, $C_1$ to $C_{10}$) alkylene or alkenylene, e.g. $—C_2H_5—$, $—(CH_2)_3—$, $—(CH_2)_4—$, $—CH=CH—$, $—C(CH_2)—CH_2—$, and the like, or $C_6$ to $C_{20}$ (preferably, $C_6$ to $C_{14}$) divalent substituted or unsubstituted arylene such as phenylene, naphthylene, bisphenylene, -phenyl-O-phenyl- and the like. Illustrative of bisfunctional reactants of formula XVI are:

$H_2C=CH—C(O)—CH—C(O)—OCH_3$
$H_2C=CH—C(O)—C_2H_4—C(O)—OCH_3$
$H_2C=CH—C(O)—C_2H_4—C(O)—OC_2H_5$
$H_2C=CH—C(O)—C_3H_6—C(O)—Cl$
$H_2C=CH—C(O)—C_2H_4—C(O)—SH$
$H_2C=CH—C(O)—C_5H_{10}—C(O)—SCH_3$
$H_2C=C(CH_3)—C(O)—C_2H_4—C(O)—OCH_3$
$H_2C=C(CH_3)—C(O)—C_2H_4—C(O)—OC_2H_5$
$H_2C=CH—C(O)—CH—C(O)—CH_3$
$H_2C=CH—C(O)—C_2H_4—C(O)—CH_3$
$H_2C=CH—C(O)—C_2H_4—C(O)—C_2H_5$
$H(CH_3)C=CH—C(O)—CH_2—C(O)—OCH_3$
$H(CH_3)C=CH—C(O)—C_2H_4—C(O)—OCH_3$
$H(CH_3)C=CH—C(O)—C_2H_4—C(O)—OC_2H_5$
$H(CH_3)C=CH—C(O)—C_3H_6—C(O)—Cl$
$H(C_2H_5)C=CH—C(O)—C_2H_4—C(O)—SH$
$H(CH_3)C=CH—C(O)—C_5H_{10}—C(O)—SCH_3$
$(CH_3)(C_2H_5)C=C(CH_3)—C(O)—C_2H_4—C(O)—OCH_3$
$H(CH_3)C=C(CH_3)—C(O)—C_2H_4—C(O)—OC_2H_5$
$H(CH_3)C=CH—C(O)—CH_2—C(O)—CH_3$
$H(CH_3)C=CH—C(O)—C_2H_4—C(O)—CH_3$
$H(CH_3)C=CH—C(O)—C_2H_4—C(O)—C_2H_5$
$Cl—C(O)—CH_2—C(O)—OCH_3$
$Cl—C(O)—C_2H_4—C(O)—OCH_3$
$Cl—C(O)—C_2H_4—C(O)—OC_2H_5$
$Cl—C(O)—C_3H_6—C(O)—OH$
$Cl—C(O)—C_2H_4—C(O)—SH$
$Cl—C(O)—C_5H_{10}—C(O)—SCH_3$
$Cl—C(O)—C_2H_4—C(O)—OCH_3$
$Cl—C(O)—C_2H_4—C(O)—OC_2H_5$

Cl—C(O)—$CH_2$—C(O)—$CH_3$
Cl—C(O)—$C_2H_4$—C(O)—$CH_3$
Cl—C(O)—$C_2H_4$—C(O)—$C_2H_5$
$CH_3O$—C(O)—$CH_2$—C(O)—OH
$CH_3O$—C(O)—$C_2H_4$—C(O)—OH
$CH_3O$—C(O)—$C_2H_4$—C(O)—SH
$CH_3O$—C(O)—$C_3H_6$—C(O)—Cl
$C_2H_5O$—C(O)—$C_2H_4$—C(O)—SH
$CH_3O$—C(O)—$C_5H_{10}$—C(O)—$SCH_3$
$CH_3S$—C(O)—$CH_2$—C(O)—$OCH_3$
$CH_3$—C(O)—$CH_2$—C(O)—OH
$CH_3$—C(O)—$C_2H_4$—C(O)—OH
$CH_3$—C(O)—$C_2H_4$—C(O)—SH

Exemplary of reactants of formula VII wherein a=b=c=1, $W^1$ and $W^2$ are O, T contains a>C=C< group and wherein X and Y together comprise —O— or —S— are:

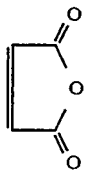

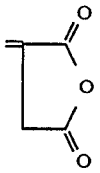

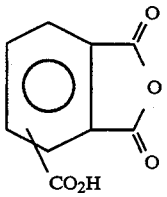

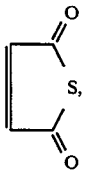

chloromaleic anhydride, and the like.

Exemplary of polyfunctional reactants of formula VII wherein a=b=1 and c>1 are compounds of the formula (XVII):

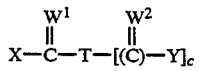

wherein $W^1$, $W^2$, X, Y, T and "c" are as defined above and wherein X and Y are different. Illustrative of compounds of formula XVII above are:

$H_2C$=CH—C(O)—$CH_2$—[C(O)—$OCH_3$]$_2$
$H_2C$=CH—C(O)—$C_2H_3$—[C(O)—$OCH_3$]$_2$
$H_2C$=CH—C(O)—ARYL—[C(O)—$OCH_3$]$_2$
$H_2C$=CH—C(O)—ARYL—[C(O)—$OCH_3$]$_2$
$H_2C$=CH—C(O)—$C_2H_3$—[C(O)—$OC_2H_5$]$_2$
$C_2C$=CH—C(O)—NAPTHYL—[C(O)—$OCH_3$]$_2$
$C_2C$=CH—C(O)—NAPHTHYL—[C(O)—$OCH_3$]$_2$
$H_2C$=CH—C(O)—$C_2H_3$—[C(O)—$OC_2H_5$]$_2$
$H_2C$=CH—C(O)—$C_3H_5$—[C(O)—Cl]$_2$
$H_2C$=CH—[C(O)—$C_2H_3$—[C(O)—SH]$_2$
$H_2C$=CH—C(O)—$C_5H_9$—[C(O)—$SCH_3$]$_2$
$H_2C$=C($CH_3$)—C(O)—$C_2H_3$—[C(O)—$OCH_3$]$_2$
$H_2C$=C($CH_3$)—C(O)—$C_2H_3$—[C(O)—$OC_2H_5$]$_2$
$H_2C$=CH—C(O)—$CH_2$—[C(O)—$CH_3$]$_2$
$H_2C$=CH—C(O)—$C_2H_3$—[C(O)—$CH_3$]$_2$
$H_2C$=CH—C(O)—ARYL—[C(O)—$CH_3$]$_2$
H($CH_3$)C=CH—C(O)—CH—[C(O)—$OCH_3$]$_2$
H($CH_3$)C=CH—C(O)—$C_2H_3$—[C(O)—$OCH_3$]$_2$
H($CH_3$)C=CH—C(O)—$C_2H_3$—[C(O)—$OC_2H_5$]$_2$
H($CH_3$)C=CH—C(O)—$C_3H_5$—[C(O)—Cl]$_2$
H($C_2H_5$)C=CH—C(O)—$C_2H_3$—[C(O)—SH]$_2$
H($CH_3$)C=CH—C(O)—$C_5H_9$—[C(O)—$SCH_3$]$_2$
($CH_3$)($C_2H_5$)C=C($CH_3$)—C(O)—$C_2H_3$—[C(O)$OCH_3$]$_2$
H($CH_3$)C=C($CH_3$)—C(O)—$C_2H_3$—[C(O)—$OC_2H_5$]$_2$
H($CH_3$)C=CH—C(O)—CH—[C(O)—$CH_3$]$_2$
H($CH_3$)C=CH—C(O)—$C_2H_3$—[C(O)—$CH_3$]$_2$
H($CH_3$)C=CH—C(O)—$C_2H_3$—[C(O)—$C_2H_5$]$_2$
Cl—C(O)—CH—[C(O)—$OCH_3$]$_2$
Cl—C(O)—$C_2H_3$—[C(O)—$OCH_3$]$_2$
Cl—C(O)—$C_2H_3$—[C(O)—$OC_2H_5$]$_2$
Cl—C(O)—$C_3H_5$—[C(O)—OH]$_2$
Cl—C(O)—$C_2H_3$—[C(O)—SH]$_2$
Cl—C(O)—$C_5H_9$—[C(O)—$SCH_3$]$_2$
Cl—C(O)—$C_2H_3$—[C(O)—$OCH_3$]$_2$
Cl—C(O)—$C_2H_3$—[C(O)—$OC_2H_5$]$_2$
Cl—C(O)—CH—[C(O)—$CH_3$]$_2$
Cl—C(O)—$C_2H_3$—[C(O)—$CH_3$]$_2$
Cl—C(O)—$C_2H_3$—[C(O)—$C_2H_5$]$_2$
$CH_3O$—C(O)—CH—[C(O)—OH]$_2$
$CH_3O$—C(O)—$C_2H_3$—[C(O)—OH]$_2$
$CH_3O$—C(O)—$C_2H_3$—[C(O)—SH]$_2$
$CH_3O$—C(O)—$C_3H_5$—[C(O)—Cl]$_2$
$C_2H_5O$—C(O)—$C_2H_3$—[C(O)—SH]$_2$
$CH_3O$—C(O)—$C_5H_9$—[C(O)—$SCH_3$]$_2$
$CH_3S$—C(O)—CH—[C(O)—$OCH_3$]$_2$
$CH_3$—C(O)—CH—[C(O)—OH]$_2$
$CH_3$—C(O)—$C_2H_3$—[C(O)—OH]$_2$
$CH_3$—C(O)—$C_2H_3$—[C(O)—SH]$_2$

Exemplary of the polyfunctional reactants of formula VII wherein a=0 and b=c=1 are bisfunctional compounds of the formula (XIX):

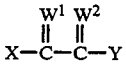

wherein $W^1$, $W^2$, X and Y are as defined above and wherein X and Y are different. Illustrative of compounds of formula XIX above are:

$C_2C$=CH—C(O)—C(O)—$OCH_3$
$C_2C$=CH—C(O)—C(O)—$OCH_3$
$H_2C$=CH—C(O)—C(O)—$OC_2H_5$
$H_2C$=CH—C(O)—C(O)—Cl
$H_2C$=CH—C(O)—C(O)—SH
$H_2C$=CH—C(O)—C(O) —$SCH_3$
$H_2C$=C($CH_3$)—C(O)—C(O)—$OCH_3$
$H_2C$=C($CH_3$)—C(O)—C(O)—$OC_2H_5$ $C_2C{=}CH{-}C(O){-}C(O){-}CH_3$
$C_2C{=}CH{-}C(O){-}C(O){-}CH_3$
$H_2C{=}CH{-}C(O){-}C(O){-}C_2H_5$
$H(CH_3)C{=}CH{-}C(O){-}C(O){-}OCH_3$
$H(CH_3)C{=}CH{-}C(O){-}C(O){-}OCH_3$
$H(CH_3)C{=}CH{-}C(O){-}C(O){-}OC_2H_5$
$H(CH_3)C{=}CH{-}C(O){-}C(O){-}Cl$
$H(C_2H_5)C{=}CH{-}C(O){-}C(O){-}SH$
$H(CH_3)C{=}CH{-}C(O){-}C(O){-}SCH_3$
$(CH_3)(C_2H_5)C{=}C(CH_3){-}C(O){-}C(O){-}OCH_3$
$H(CH_3)C{=}C(CH_3){-}C(O){-}C(O){-}OC_2H_5$
$H(CH_3)C{=}CH{-}C(O){-}C(O){-}CH_3$
$H(CH_3)C{=}CH{-}C(O){-}C(O){-}CH_3$
$H(CH_3)C{=}CH{-}C(O){-}C(O){-}C_2H_5$
$Cl{-}C(O){-}C(O){-}OCH_3$
$Cl{-}C(O){-}C(O){-}OCH_3$
$Cl{-}C(O){-}C(O){-}OC_2H_5$
$Cl{-}C(O){-}C(O){-}OH$
$Cl{-}C(O){-}C(O){-}SH$
$Cl{-}C(O){-}C(O){-}SCH_3$
$Cl{-}C(O){-}C(O){-}OCH_3$
$Cl{-}C(O){-}C(O){-}OC_2H_5$
$Cl{-}C(O){-}C(O){-}CH_3$
$Cl{-}C(O){-}C(O){-}CH_3$
$Cl{-}C(O){-}C(O){-}C_2H_5$
$CH_3O{-}C(O){-}C(O){-}OH$
$C_2H_5{-}C(O){-}C(O){-}OH$
$CH_3O{-}C(O){-}C(O){-}SH$
$CH_3O{-}C(O){-}C(O){-}Cl$
$C_2H_5O{-}C(O){-}C(O){-}SH$
$CH_3O{-}C(O){-}C(O){-}SCH_3$
$CH_3O{-}C(O){-}C(O){-}OCH_3$
$CH_3{-}C(O){-}C(O){-}OH$
$C_2H_5{-}C(O){-}C(O){-}OH$
$CH_3O{-}C(O){-}C(O){-}SH$

Also useful as polyfunctional reactants in the present invention are compounds of the formula (XX):

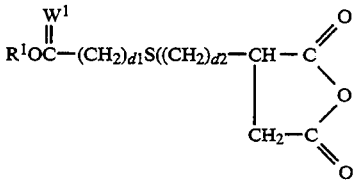

wherein $R^1$ and $W^1$ are as defined above, and wherein "d1" and "d2" are each integers of from 1 to 10; compounds of the formula (XXI):

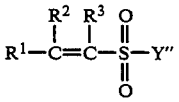

wherein $R^1$, $R^2$, and $R^3$ are the same or different and are hydrogen or substituted or unsubstituted hydrocarbyl as defined above, and wherein "Y" comprises a reactive functional group selected from the group consisting of: halide, $-OR^4$, $-SR^4$, $-N(R^4)(R^5)$, $-Z^1C(O)OR^4$ and $-(R^3)C{=}C(R^1)(R^2)$, where in $R^4$ is H or substituted or unsubstituted hydrocarbyl as defined above, and compounds of the formula (XXIa):

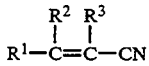

wherein $R^1$, $R^2$, $R^3$ and are the same or different and are hydrogen or substituted or unsubstituted hydrocarbyl as defined above.

Examples of such compounds of formula XX are:
$CH_3OC(O)C_2H_4SCH_2{-}ANHY$
$CH_3OC(O)CH_2SCH_2{-}ANHY$
$CH_3OC(O)C_3H_6SCH_2{-}ANHY$
$CH_3OC(O)C(CH_3)_2SCH_2{-}ANHY$
$CH_3OC(O)CH(CH_3)\ SCH_2{-}ANHY$
$C_2H_5OC(O)C_2H_4\ SCH_2{-}ANHY$
$C_2H_5OC(O)CH_2SCH_2{-}ANHY$
$C_2H_5OC(O)C_3H_6SCH_2{-}ANHY$
$C_2H_5OC(O)C(CH_3)_2SCH_2{-}ANHY$
$C_2H_5OC(O)CH(CH_3)SCH_2{-}ANHY$
wherein ANHY is the moiety:

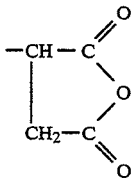

Examples of such compounds of formula XXI are:
$H_2C{=}CH{-}S(O)_2{-}OCH_3$
$H_2C{=}CH{-}S(O)_2{-}OCH_3$
$H_2\ C{=}CH{-}S(O)_2{-}OC_2H_5$
$H_2C{=}CH{-}S(O)_2{-}Cl$
$H_2C{=}CH{-}S(O)_2{-}SH$
$H_2C{=}CH{-}S(O)_2{-}SCH_3$
$H_2C{=}C(CH_3){-}S(O)_2{-}OCH_3$
$H_2C{=}C(CH_3){-}S(O)_2{-}OC_2H_5$
$H_2C{=}CH{-}S(O)_2{-}OCH(CH_3)_2$
$H(CH_3)C{=}CH{-}S(O)_2{-}OCH_3$
$H(CH_3)C{=}CH{-}S(O)_2{-}OCH_3$
$H(CH_3)C{=}CH{-}S(O)_2{-}OC_2H_5$
$H(CH_3)C{=}CH{-}S(O)_2{-}Cl$
$H(C_2H_5)C{=}CH{-}S(O)_2{-}SH$
$H(CH_3)C{=}CH{-}S(O)_2{-}SCH_3$
$(CH_3)(C_2H_5)C{=}C(CH_3){-}S(O)_2{-}OCH_3$
$H(CH_3)C{=}C(CH_3){-}S(O)_2{-}OC_2H_5$ Examples of such compounds of formula XXIa are:
$H_2C{=}CH{-}CN$
$H_2C{=}C(CH_3){-}CN$
$H(CH_3)C{=}CH{-}CN$
$H(C_2H_5)C{=}CH{-}CN$
$H(CH_3)C{=}C(CH_3){-}CN$
$(CH_3)\ (C_2H_5)C{=}C(CH_3){-}CN$ Preferred compounds for reaction with the first nitrogen-containing compound in accordance with this invention are lower alkyl esters of acrylic and lower alkyl alpha-substituted acrylic acid. Illustrative of such preferred compounds are compounds of the formula:

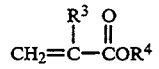

(XXIII)

where $R^3$ is hydrogen or a $C_1$ to $C_4$ alkyl group, such as methyl, and $R^4$ is hydrogen or a $C_1$ to $C_4$ alkyl group, capable of being removed so as to form an amido group, for example, methyl, ethyl, propyl, isopropyl, butyl, sec-butyl, tert-butyl, aryl, hexyl, etc. e.g., propyl acrylate and propyl methacrylate. In the most preferred embodiments these compounds are acryiic and methacrylic esters such as methyl or ethyl acrylate, methyl or ethyl methacrylate.

The polyfunctional reactants useful in this invention are known materials and can be prepared by conventional methods known to those skilled in the art, which need not be described herein.

PREPARATION OF THE FIRST ADDUCT

The selected first nitrogen-containing compound and polyfunctional reactant are contacted in a first reaction mixture in an amount and under conditions sufficient to react the X functional groups of the latter with at least a portion of, and preferably substantially all of, the reactive nitrogen moieties in the first nitrogen-containing compound.

In preparing the first adduct, it is preferred that the moles of the polyfunctional reactant employed be at least equal to the equivalents of the reactive nitrogen moieties in the first nitrogen-containing compound (that is, the sum of the nitrogen-bonded H atoms in the first nitrogen-containing compound). Preferably, a molar excess of the polyfunctional reactant of about at least 10%, such as 10–300%, or greater, for example, 25–200%, is employed. Larger excess can be employed if desired. For example, $NH_3$ is herein considered to have three reactive nitrogen moieties per molecule, and preferably at least 3 (e.g., from 3.3–10) moles of the polyfunctional reactant are employed in the first reaction mixture per mole of $NH_3$, to form a first adduct having, on average, three N-bonded moieties derived from the polyfunctional reactant, each such moiety containing the group (XXIII):

$$-\overset{\overset{W^1}{\|}}{C}-(T)_a-[\overset{\overset{W^2}{\|}}{(C)}_b-(Y)]_c$$

wherein $W^1$, $W^2$, Y, T, "a", "b" and "c" are as defined above. Preferably, the first adduct contains on average at least 3 groups, more preferably from 3 to 20, and most preferably from 3 to 8, groups of formula XXIII.

The polyfunctional reactant and first nitrogen compound are preferably admixed by introducing the first nitrogen compound into the liquid reaction mixture containing the polyfunctional reactant, with mixing, to provide an excess of the polyfunctional reactant during the charging of the first nitrogen compound.

The conditions of the temperature and pressure employed for employed for contacting of the first nitrogen-containing compound and the polyfunctional reactant can vary widely but will be generally from about −10° to 40° C. (preferably from about 10° to 20° C.). The progress of the reaction can be followed by IR to observe the disappearance of —N—H— bonds. Lower temperatures can be used, although longer reaction times may be required. Higher temperatures can also be employed but will tend to increase the amount of the less reactive Y functional groups which react with the reactive nitrogen moieties of the first nitrogen-containing compound, thereby decreasing the desired selectivity for the reaction with the more reactive X functional groups.

The reaction time involved can vary widely depending on a wide variety of factors. For example, there is a relationship between time and temperature. In general, lower temperature demands longer times. Usually, reaction times of from about 2 to 30 hours, such as 5 to 25 hours, and preferably 3 to 10 hours will be employed.

Although one can employ a solvent, the reaction can be run without the use of any solvent. It is preferred to avoid the use of an aqueous solvent such as water. However, taking into consideration the effect of solvent on the reaction, where desired, any suitable solvent can be employed, whether organic or inorganic, polar or nonpolar. Suitable solvents include alkanols (e.g., $C_1$ to $C_6$ alkanols such as methanol, isopropanol, ethanol and the like), ethers, xylene, benzene, toluene, tretrahydrofuran, methlyene chloride, chloroform, chlorobenzene, and the like.

The resulting first adduct product mixture is then preferably treated, as by stripping or sparging (with, e.g., nitrogen gas) (e.g., from about 20° to about 100° C.) optionally under vacuum to remove any volatile reaction by-products and unreacted polyfunctional reactant to minimize the reaction of the second nitrogen-containing compound therewith in the second stage of the process of the present invention. Therefore, the second liquid reaction mixture, wherein the second adduct is formed, is preferably substantially free of unreacted polyfunctional reactant, e.g. contains less than about 1 wt %, and more preferably about 0.1 wt % unreacted polyfunctional reactant.

The reaction of the polyfunctional reactants of formula VII with a first nitrogen-containing compound can be illustrated as follows:

monoamines (Eq. 1)

$$NH_3 + 3\,H_2C{=}CH{-}\overset{\overset{O}{\|}}{C}{-}OCH_3 \longrightarrow N{-}[C_2H_4\overset{\overset{O}{\|}}{C}{-}OCH_3]_3$$

(Eq. 2)

$$NH_2R^1 + 2\,H_2C{=}C(CH_3){-}\overset{\overset{O}{\|}}{C}{-}OCH_3 \longrightarrow R^1{-}N{-}[CH_2C(CH_3)\overset{\overset{O}{\|}}{C}{-}OCH_3]_2$$

polyamines (Eq. 3)

$$H_2NC_2H_4NH_2 + 4\,H_2C{=}CH{-}\overset{\overset{O}{\|}}{C}{-}OCH_3 \longrightarrow NC_2H_4N{-}[C_2H_4\overset{\overset{O}{\|}}{C}{-}OCH_3]_2,\ [C_2H_4\overset{\overset{O}{\|}}{C}{-}OCH_3]_2$$

(Eq. 4)

$$H_2N(C_2H_4NH)_4C_2H_4NH_2 + 8\,H_2C{=}CH{-}\overset{\overset{O}{\|}}{C}{-}OCH_3 \longrightarrow N[C_2H_4NH]_4C_2H_4N{-}[C_2H_4\overset{\overset{O}{\|}}{C}{-}OCH_3]_2,\ [C_2H_4\overset{\overset{O}{\|}}{C}{-}OCH_3],\ [C_2H_4\overset{\overset{O}{\|}}{C}{-}OCH_3]_2$$

-continued

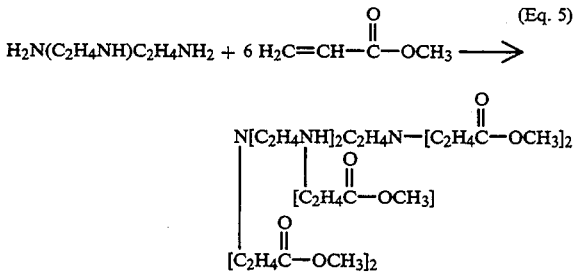

(Eq. 5)

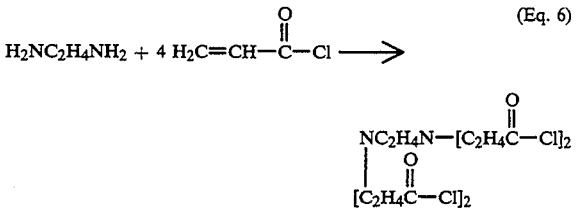

(Eq. 6)

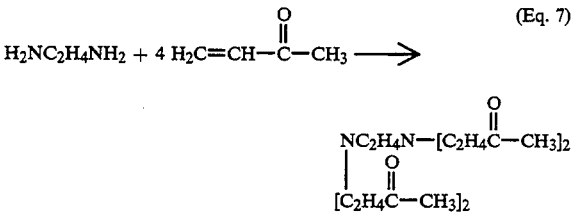

(Eq. 7)

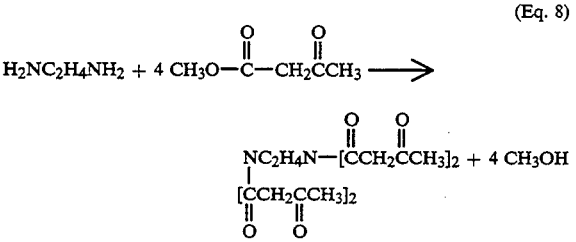

(Eq. 8)

The selective reaction of the first nitrogen-containing compound with an alpha- beta ethylenically unsaturated compound of formula VII results in the addition of the reactive nitrogen equivalents across the double bond of these polyfunctional reactants.

The average degree of branching in the first adduct is increased as the number of reactive nitrogen moieties in the first nitrogen-containing compound increases.

The average degree of branching ("$DB_1$") of the first adduct can be calculated from the expression:

$$DB_1=[3(n_a)+2(n_p)+(n_s)]x\ c$$

wherein "$n_a$" is 1 when ammonia is employed as the first nitrogen-containing compound and is zero when ammonia is not used, and wherein "$n_p$" and "$n_s$" are the number of primary and secondary amine groups, respectively, in the organic amine, if employed as the first nitrogen-containing compound, and wherein "c" is an integer of at least 1 (and is equal to (r−1), wherein "r" is the number of functional groups in each molecule of the polyfunctional reactant which are reactive with a —NH— group, as defined in formula VII above). $DB_1$ in the first adduct is at least 2 (e.g., from 2 to 30), preferably at least 3 (e.g., from 3 to 20), and more preferably from 3 to 15. When the first nitrogen-containing compound comprises a mixture of ammonia and an organic amine the average degree of branching can be determined by giving each of the factors in the above expression their weighted average of each such nitrogen-containing compound incorporated into the first adduct.

For example, ammonia provides a 3-branch first adduct ($DB_1=3$)

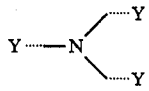

whereas diethylene triamine provides a 5-branch first adduct ($DB_1=5$)

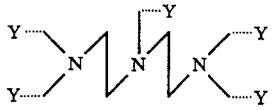

wherein . . . Y represents a difunctional reactant which has been bonded to the reactive nitrogen moieties. The degree of branching will be increased still further if a trifunctional reactant is employed. For example, ammonia preferably provides a first adduct of the structure ($DB_1=6$):

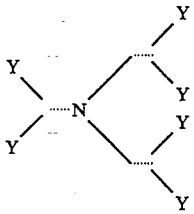

and diethylene triamine provides a first adduct of the structure ($DB_1=10$):

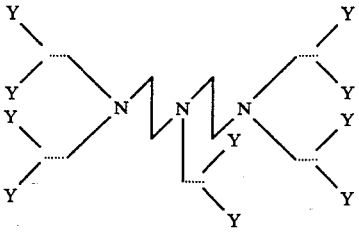

wherein

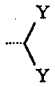

represents a trifunctional reactant which has been bonded to the reactive nitrogen moieties.

SECOND NITROGEN-CONTAINING COMPOUND

The second nitrogen-containing compound will comprise at least one polyamine containing at least 2 (e.g. from 2 to 20), preferably at least 3 (e.g. from 3 to 15), and most preferably from 3 to 10, reactive nitrogen moieties, that is the total of the nitrogen-bonded H atoms per molecule of the second nitrogen-containing compound. The second nitrogen-containing compound will generally comprise at least one member selected from the group consisting of organic primary and secondary polyamines containing at least one primary amine group (and preferably containing at least two (e.g., 2 to 6, preferably 2 to 4) primary amine groups) or at least two secondary amine groups per molecule. Generally, the organic polyamines will contain from about 2 to 60, preferably 2 to 40 (e.g. 3 to 20), total carbon atoms and about 2 to 12, preferably 3 to 12, and most preferably from 3 to 8 (e.g., 5 to 9) total nitrogen atoms in the molecule. These amines may be hydrocarbyl amines or may be hydrocarbyl amines including other groups, e.g., hydroxy groups, alkoxy groups, amide groups, nitriles, imidazoline groups, and the like. Hydroxy amines with 1 to 6 hydroxy groups, preferably 1 to 3 hydroxy groups are particularly useful. Preferred amines are aliphatic saturated amines, including those of the general formulas:

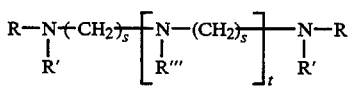

(XXIV)

wherein R, R′ and R‴ are independently selected from the group consisting of hydrogen; $C_1$ to $C_{25}$ straight or branched chain alkyl radicals; $C_1$ to $C_{12}$ alkoxy $C_2$ to $C_6$ alkylene radicals; $C_2$ to $C_{12}$ hydroxy amino alkylene radicals; and $C_1$ to $C_{12}$ alkylamino $C_2$ to $C_6$ alkylene radicals; and wherein R‴ can additionally comprise a moiety of the formula:

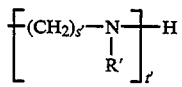

(XXV)

wherein R′ is as defined above, and wherein s and s′ can be the same or a different number of from 2 to 6, preferably 2 to 4; and t and t′ can be the same or different and are numbers of from 0 to 10, preferably 2 to 7, and most preferably about 3 to 7, with the proviso that the sum of t and t′ is not greater than 15. To assure a facile reaction, it is preferred that R, R′, R‴, s, s′, t and t′ be selected in a manner sufficient to provide the compounds of Formula XXIV with typically at least two primary or secondary amine group, preferably a total of from 2 to 8 primary and secondary amine groups. This can be achieved by selecting at least one of said R, R′ or R‴ groups to be hydrogen or by letting t in Formula XXIV be at least one when R‴ is H or when the XXV moiety possesses a secondary amino group.

Non-limiting examples of suitable organic amine compounds include: 1,2-diaminoethane; 1,3-diaminopropane; 1,4-diaminobutane; 1,6-diaminohexane; polyethylene amines such as diethylene triamine; triethylene tetramine; tetraethylene pentamine; polypropylene amines such as 1,2-propylene diamine; di-(1,2-propylene)triamine; di- (1,3-propylene) triamine; N,N-dimethyl-1,3-diaminopropane; N,N-di-(2-aminoethyl) ethylene diamine; N,N-di(2-hydroxyethyl) -1,3-propylene diamine; 3-dodecyloxypropylamine; N-dodecyl-1,3-propane diamine; tris hydroxymethylaminomethane (THAM); diisopropanol amine; diethanoi amine; triethanoi amine; mono-, di-, and tri-tallow amines; amino morpholines such as N-(3-aminopropyl) morpholine; and mixtures thereof.

Other useful amine compounds include those discussed above with respect to the first nitrogen-containing adduct in formulae IV–VI.

Commercial mixtures of amine compounds may advantageously be used. For example, one process for preparing alkylene amines involves the reaction of an involves the reaction of an alkylene dihalide (such as ethylene dichloride or propylene dichloride) with ammonia, which results in a complex mixture of alkylene amines wherein pairs of nitrogens are joined by alkylene groups, forming such compounds as diethylene triamine, triethylene tetramine, tetraethylene pentamine and isomeric piperazines. Low cost poly (ethyleneamines) compounds averaging about 5 to 7 nitrogen atoms per molecule are available commercially under trade names such as "Polyamine H", "Polyamine 400", "Dow Polyamine E-100", etc.

The second nitrogen-containing compound can comprise an amido-amine formed by reacting a polyamine with an alpha, beta-ethylenically unsaturated compound (e.g., of formula XXII), e.g. by reacting polyethylene amines (e.g., tetraethylene pentaamine, pentaethylene hexamine, and the like), polyoxyethylene and polyoxypropylene amines, e.g., polyoxypropylene diamine, trismethylolaminomethane and pentaerythritol, and combinations thereof, with with an acrylate-type compound of formula (XXII) above, and most preferably with an acrylate-type reactant selected from the group consisting of lower alkyl alky-acrylates (e.g., methyl, ethyl, iso-propyl, propyl, iso-butyl, n-butyl, tert-butyl, etc., esters of methacrylic acid, acrylic acid, and the like).

Exemplary of such amido-amines are compounds of the formula:

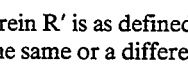

$$NH_2[(CH_2)_zNH]_xC(O)C_2H_4[NH(CH_2)_z]_xNH_2$$

wherein x is an integer of from 1 to 10, and z is an integer of from 2 to 6.

Most preferred as the second nitrogen-containing compound are members selected from the group consisting of organic diprimary amines having from 2 to 30 carbon atoms, from 2 to 12 total nitrogen atoms and from 0 to 10 secondary nitrogen atoms per molecule. Examples of such preferred organic diprimary amines are ethylene diamine, propylene diamine, diethylene triamine, dipropylene triamine, triethylene tetraamine, tripropylene tetraamine, tetraethylene pentaamine, tetrapropylene pentaamine, polyamino cyclohexylmethane and the like.

PREPARATION OF SECOND ADDUCT

The first adduct, containing an average of at least 2 (e.g., 2 to 10), and preferably at least 3 (e.g. from 3 to 8), unreacted functional Y groups per molecule, is contacted with the second nitrogen-containing compound in an amount and under conditions sufficient to react the remaining functional groups with the reactive nitrogen moieties of the second nitrogen-containing compound to form a second adduct characterized by having within its structure on average (i) at least two, (e.g., 2 to 30), preferably at least 3 (e.g., 3 to 20), nitrogen-containing moieties derived from the second nitrogen-containing compound per nitrogen-containing moiety derived from the first compound and (ii) at least two (e.g., 2 to 6; preferably 2 to 4) unreacted primary or secondary amine groups.

The reaction of a polyamine with the first adduct can be illustrated as follows:

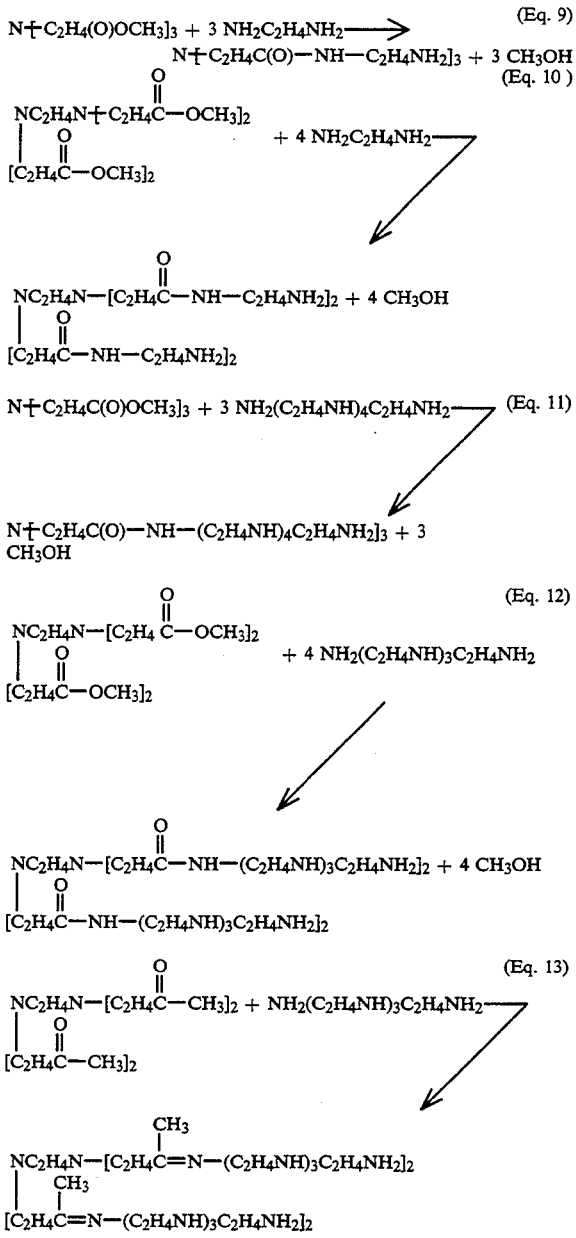

The reaction between the selected polyamine and the first adduct is carried out at any suitable temperature. Temperatures up to the decomposition points of reactants and .products can be employed. In practice, one generally carries out the reaction by heating the reactants below 100° C., such as 80°-90° C., for a suitable period of time, such as a few hours. Where the first adduct was formed using an acrylic-type ester is employed, the progress of the reaction can be judged by the removal of the alcohol in forming the amide. During the early part of the reaction alcohol is removed quite readily below 100° C. in the case of low boiling alcohols such as methanol or ethanol. As the reaction slows, the temperature is raised to push the reaction to completion and the temperature may be raised to 150° C. toward the end of the reaction. Removal of alcohol is a convenient method of judging the progress and completion of the reaction which is generally continued until no more alcohol is evolved. Based on removal of alcohol, the yields are generally stoichiometric. In more difficult reactions, yields of at least 95% are generally obtained.

Similarly, it will be understood that the reaction of a polyamine with a first adduct prepared using an ethylenically unsaturated carboxylate thioester of formula X liberates the corresponding $HSR^4$ compound (e.g., $H_2S$ when $R^4$ is hydrogen) as a by-product, and the reaction of a polyamine with a first adduct prepared using an ethylenically unsaturated carboxyamide of formula XI liberates the corresponding $HNR^4(R^5)$ compound (e.g., ammonia when $R^4$ and $R^5$ are each hydrogen) as by-product in forming the second adduct.

The reaction time involved can vary widely depending on a wide variety of factors. For example, there is a relationship between time and temperature. In general, lower temperature (e.g., at about 25° C.) demands longer times. Usually, reaction times of from about 2 to 30 hours, such as 5 to 25 hours, and preferably 3 to 10 hours will be employed.

Although one can employ a solvent, the reaction can be run without the use of any solvent. It is preferred to avoid the use of an aqueous solvent such as water. However, taking into consideration the effect of solvent on the reaction, where desired, any suitable solvent can be employed, whether organic or inorganic, polar or nonpolar. Suitable solvents include alkanols (e.g., $C_1$ to $C_6$ alkanols such as methanol, isopropanol, ethanol and the like), ethers, xylene, benzene, toluene, tretrahydrofuran, methylene chloride, chloroform, chlorobenzene, and the like.

When the selected polyfunctional reactant comprises an alpha, beta-unsaturated compound of formula VII wherein $W^1$ is oxygen, the resulting first adduct reaction product contains at least one amido linkage (—C(O)N<) and such materials are herein termed "amido-amines." Similarly, when the selected alpha, beta unsaturated compound of formula VII comprises a compound wherein W is sulfur, the resulting reaction product with the polyamine contains thioamide linkage (—C(S)N<) and these materials are herein termed "thioamido-amines." For convenience, the following discussion is directed to the preparation and use of amido-amines, although it will be understood that such discussion is also applicable to the thioamido-amines.

These amido-amine adducts so formed are characterized by both amido and amino groups. In their simplest embodiments they may be represented by units of the following idealized formula:

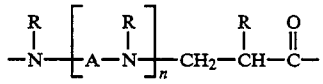

wherein the R's, which may be the same or different, are hydrogen or a substituted group, such as a hydrocarbon group, for example, alkyl, alkenyl, alkynyl, aryl, etc., and A is a moiety of the polyamine which, for example, may be aryl, cycloalkyl, alkyl, etc., and n is an integer such as 1-10 or greater. The amido-amine adducts preferably contain an average of from 1 to 3 amido groups per molecule of the amido-amine adduct.

Preferably, however, the amido-amines of this invention are not cross-linked to any substantial degree, and more preferably are substantially branched.

Steps (a) and (b) in the process of this invention can be repeated if desired to form more highly branched adducts. For example, a second adduct formed as described above can comprise the "first nitrogen-containing compound" passed to the repeated step (a ) and can be therein contacted with additional polyfunctional reactant (e.g., an alpha, beta-ethylenically unsaturated carboxylate), preferably in a molar excess to the reactive nitrogen moieties in the second adduct (that is, the total number of —N—H— bonds remaining unreacted in the second adduct), to form a more highly branched "first" adduct which can then be treated to remove the excess unreacted polyfunctional reactant and contacted in a separate step with an additional second nitrogen-containing compound, such as a polyalkylene polyamine, as described above. Such more highly branched nitrogen-containing adduct will be characterized as indicated above for the second adducts (that is, on average, will contain in its structure at least two unreacted primary or secondary amine groups, and at least two nitrogen-containing moieties derived from the additional second nitrogen-containing compound per nitrogen-containing moiety derived from the nitrogen-containing adduct so contacted in the repeat of step (a)) and can be employed in the subsequent reaction with the selected reactants A—D to form a dispersant of this invention.

PREPARATION OF LONG CHAIN HYDROCARBYL SUBSTITUTED REACTANT (A) AS indicated above, the dispersant materials of this invention can be prepared by reacting the second adduct with a hydrocarbyl-substituted acid, anhydride or ester material. The long chain hydrocarbyl polymer-substituted mono- or dicarboxylic acid material, i.e., acid, anhydride or acid ester used in this invention, includes the reaction product of a long chain hydrocarbon polymer, generally a polyolefin, with a mono unsaturated carboxylic reactant comprising at least one member selected from the group consisting of (i) mono unsaturated $C_4$ to $C_{10}$ dicarboxylic acid (preferably wherein (a) the carboxyl groups are vicinyl, (i.e. located on adjacent carbon atoms ) and (b) at least one, preferably both, of said adjacent carbon atoms are part of said mono unsaturation); (ii) derivatives of (i) such as anhydrides or $C_1$ to $C_5$ alcohol derived mono- or di-esters of (i); (iii) mono unsaturated $C_3$ to $C_{10}$ monocarboxylic acid wherein the carbon-carbon double bond is conjugated to the carboxy group, i.e., of the structure $$-C{=}C-\overset{\overset{\displaystyle O}{\|}}{C}-;$$

and (iv) derivatives of (iii) such as $C_1$ to $C_5$ alcohol derived monoesters of (iii). Upon reaction with the polymer, the monounsaturation of the mono unsaturated carboxylic reactant becomes saturated. Thus, for example, maleic anhydride becomes a polymer substituted succinic anhydride, and acrylic acid becomes a polymer substituted propionic acid.

Typically, from about 0.7 to about 4.0 (e.g., 0.8 to 2.6), preferably from about 1.0 to about 2.0, and most preferably from about 1.1 to about 1.7 moles of sâid mono unsaturated carboxylic reactant are charged to the reactor per mole of polymer charged.

Normally, not all of the polymer reacts with the monounsaturated carboxylic reactant and the reaction mixture will contain non-acid substituted polymer. The polymer-substituted mono- or dicarboxylic acid material (also referred to herein as "functionalized" polymer or polyolefin), non-acid substituted polyolefin, and any other polymeric by-products, e.g. chlorinated polyolefin, (also referred to herein as "unfunctionalized" polymer) are collectively referred to herein as "product residue" or "product mixture". The non-acid substituted polymer is typically not removed from the reaction mixture (because such removal is difficult and would be commercially infeasible) and the product mixture, stripped of any mono unsaturated carboxylic reactant is employed for further reaction with the amine or alcohol as described hereinafter make the dispersant.

Characterization of the average number of moles of mono unsaturated carboxylic reactant which have reacted per mole of polymer charged to the reaction (whether it has undergone reaction or not) is defined herein as functionality. Said functionality is based upon (i) determination of the saponification number of the resulting product mixture using potassium hydroxide; and (ii) the number average molecular weight of the polymer charged, using techniques well known in the art. Functionality is defined solely with reference to the resulting product mixture. Although the amount of said reacted polymer contained in the resulting product mixture can be subsequently modified, i.e. increased or decreased by techniques known in the art, such modifications do not alter functionality as defined above. The terms "polymer substituted monocarboxylic acid material" and "polymer substituted dicarboxylic acid material" as used herein are intended to refer to the product mixture whether it has undergone such modification or not.

Accordingly, the functionality of the polymer substituted mono- and dicarboxylic acid material will be typically at least about 0.5, preferably at least about 0.8, and most preferably at least about 0.9 and will vary typically from about 0.5 to about 2.8 (e.g., 0.6 to 2), preferably from about 0.8 to about 1.4, and most preferably from about 0.9 to about 1.3.

Exemplary of such mono unsaturated carboxylic reactants are fumaric acid, itaconic acid, maleic acid, maleic anhydride, chloromaleic acid, chloromaleic anhydride, acrylic acid, methacrylic acid, crotonic acid, cinnamic acid, and lower alkyl (e.g., $C_1$ to $C_4$ alkyl) acid esters of the foregoing, e.g., methyl maleate, ethyl fumarate, methyl fumarate, etc.

Preferred olefin polymers for reaction with the mono unsaturated carboxylic reactants to form reactant A are polymers comprising a major molar amount of $C_2$ to $C_{10}$, e.g. $C_2$ to $C_5$ monoolefin. Such olefins include ethylene, propylene, butylene, isobutylene, pentene, octene-1, styrene, etc. The polymers can be homopolymers such as polyisobutylene, as well as copolymers of two or more of such olefins such as copolymers of: ethylene and propylene; butylene and isobutylene; propylene and isobutylene; etc. Mixtures of polymers prepared by polymerization of mixtures of isobutylene, butene-1 and butene-2, e.g., polyisobutylene wherein up to about 40% of the monomer units are derived from butene-1 and butene-2, is an exemplary, and preferred, olefin polymer. Other copolymers include those in which a minor molar amount of the copolymer monomers, e.g., 1 to 10 mole %, is a $C_4$ to $C_{18}$ non-conjugated diolefin, e.g., a copolymer of isobutylene and butadiene; or a copolymer of ethylene, propylene and 1,4-hexadiene; etc.

In some cases, the olefin polymer may be completely saturated, for example an ethylene-propylene copolymer made by a Ziegler-Natta synthesis using hydrogen as a moderator to control molecular weight.

The olefin polymers used in the formation of reactant A will have number average molecular weights within the range of about 300 to 10,000, generally from about 700 and about 5,000, preferably from about 1000 to 4,000, more preferably between about 1300 and about 3,000. Particularly useful olefin polymers have number average molecular weights within the range of about 1500 and about 3000 with approximately one terminal double bond per polymer chain. An especially useful starting material for highly potent dispersant additives useful in accordance with this invention is polyisobutylene, wherein up to about 40% of the monomer units are derived from butene-1 and/or butene-2. The number average molecular weight for such polymers can be determined by several known techniques. A convenient method for such determination is by gel permeation chromatography (GPC) which additionally provides molecular weight distribution information, see W. W. Yau, J. J. Kirkland and D. D. Bly, "Modern Size Exclusion Liquid Chromatography", John Wiley and Sons, New York, 1979.

The olefin polymers will generally have a molecular weight distribution (the ratio of the weight average molecular weight to number average molecular weight, i.e. $\overline{M}_w/\overline{M}_n$) of from about 1.0 to 4.5, and more typically from about 1.5 to 3.0.

The polymer can be reacted with the mono unsaturated carboxylic reactant by a variety of methods. For example, the polymer can be first halogenated, chlorinated or brominated to about 1 to 8 wt. %, preferably 3 to 7 wt. % chlorine, or bromine, based on the weight of polymer, by passing the chlorine or bromine through the polymer at a temperature of 60° to 250° C., preferably 110° to 160° C., e.g. 120° to 140° C., for about 0.5 to 10, preferably 1 to 7 hours. The halogenated polymer may then be reacted with Sufficient mono unsaturated carboxylic reactant at 100° to 250° C., usually about 180° to 235° C., for about 0.5 to 10, e.g. 3 to 8 hours, so the product obtained will contain the desired number of moles of the mono unsaturated carboxylic reactant per mole of the halogenated polymer. Processes of this general type are taught in U.S. Pat. Nos. 3,087,436; 3,172,892; 3,272,746 and others. Alternatively, the polymer and the mono unsaturated carboxylic reactant are mixed and heated while adding chlorine to the hot material. Processes of this type are disclosed in U.S. Pat. Nos. 3,215,707; 3,231,587; 3,912,764; 4,110,349; 4,234,435; and in U.K. 1,440,219.

Alternately, the polymer and the mono unsaturated carboxylic reactant can be contacted at elevated temperature to cause a thermal "ene" reaction to take place. Thermal "ene" reactions have been heretofore described in U.S. Pat. Nos. 3,361,673 and 3,401,118, the disclosures of which are hereby incorporated by reference in their entirety.

Preferably, the polymers used in this invention contain less than 5 wt %, more preferably less than 2 wt %, and most preferably less than 1 wt % of a polymer fraction comprising polymer molecules having a molecular weight of less than about 300, as determined by high temperature gel premeation chromatography employing the corresponding polymer calibration curve. Such preferred polymers have been found to permit the preparation of reaction products, particularly when employing maleic anhydride as the unsaturated acid reactant, with decreased sediment. In the event the polymer produced as described above contains greater than about 5 wt % of such a low molecular weight polymer fraction, the polymer can be first treated by conventional means to remove the low molecular weight fraction to the desired level prior to initiating the ene reaction, and preferably prior to contacing the polymer with the selected unsaturated carboxylic reactant(s). For example, the polymer can be heated, preferably with inert gas (e.g., nitrogen) stripping, at elevated temperature under a reduced pressure to volatilize the low molecular weight polymer components which can then be removed from the heat treatment vessel. The precise temperature, pressure and time for such heat treatment can vary widely depending on such factors as as the polymer number average molecular weight, the amount of the low molecular weight fraction to be removed, the particular monomers employed and other factors. Generally, a temperature of from about 60° to 100° C. and a pressure of from about 0.1 to 0.9 atmospheres and a time of from about 0.5 to 20 hours (e.g., 2 to 8 hours) will be sufficient.

In this process, the selected polymer and mono unsaturated carboxylic reactant and halogen (e.g., chlorine gas), where employed, are contacted for a time and under conditions effective to form the desired polymer substituted mono- or dicarboxylic acid material. Generally, the polymer and mono unsaturated carboxylic reactant will be contacted in a unsaturated carboxylic reactant to polymer mole ratio usually from about 0.7:1 to 4:1, and preferably from about 1:1 to 2:1, at an elevated temperature, generally from about 120° to 260° C., preferably from about 160° to 240° C. The mole ratio of halogen to monounsaturated carboxylic reactant charged will also vary and will generally range from about 0.5:1 to 4:1, and more typically from about 0.7:1 to 2:1 (e.g., from about 0.9 to 1.4:1). The reaction will be generally carried out, with stirring for a time of from about 1 to 20 hours, preferably from about 2 to 6 hours.

By the use of halogen, about 65 to 95 wt. % of the polyolefin, e.g. polyisobutylene will normally react with the monounsaturated carboxylic acid reactant. Upon carrying out a thermal reaction without the use of halogen or a catalyst, then usually only about 50 to 75 wt. % of the polyisobutylene will react. Chlorination helps increase the reactivity. For convenience, the aforesaid functionality ratios of mono- or dicarboxylic acid producing units to polyolefin, e.g., 1.1 to 1.8, etc. are based upon the total amount of polyolefin, that is, the total of both the reacted and unreacted polyolefin, used to make the product.

The reaction is preferably conducted in the substantial absence of $O_2$ and water (to avoid competing side reactions), and to this end can be conducted in an atmosphere of dry $N_2$ gas or other gas inert under the reaction conditions. The reactants can be charged separately or together as a mixture to the reaction zone, and the reaction can be carried out continuously, semi-continuously or batchwise. Although not generally necessary, the reaction can be carried out in the presence of a liquid diluent or solvent, e.g., a hydrocarbon diluent such as mineral lubricating oil, toluene, xylene, dichlorobenzene and the like. The polymer substituted mono- or dicarboxylic acid material thus formed can be recovered from the liquid reaction mixture, e.g., after stripping the reaction mixture, if desired, with an inert gas such as $N_2$ to remove unreacted unsaturated carboxylic reactant.

If desired, a catalyst or promoter for reaction of the olefin polymer and mono unsaturated carboxylic reactant (whether the olefin polymer and mono unsaturated carboxylic reactant are contacted in the presence or absence of halogen (e.g., chlorine)) can be employed in the reaction zone. Such catalyst or promoters include alkoxides of Ti, Zr, V and Al, and nickel salts (e.g., Ni acetoacetonate and Ni iodide) which catalysts or promoters will be generally employed in an amount of from about 1 to 5,000 ppm by weight, based on the mass of the reaction medium.

(B) Also useful as long chain hydrocarbyl reactants to form the improved dispersants of this invention are halogenated long chain aliphatic hydrocarbons (as shown in U.S. Pat. Nos. 3,275,554 and 3,565,804, the disclosures of which are hereby incorporated by reference in their entirety) where the halogen group on the halogenated hydrocarbon is displaced with the second adduct in the subsequent reaction therewith.

(C) Another class of long chain hydrocarbyl reactants to form the improved dispersants of this invention are any of the long chain hydrocarbyl-substituted hydroxy aromatic compounds which are known in the art as useful for forming Mannich condensation products. Such Mannich condensation products generally are prepared by condensing about 1 mole of a high molecular weight hydrocarbyl substituted hydroxy aromatic compound (e.g., having a number average molecular weight of 700 or greater) with about 1 to 2.5 moles of an aldehyde such as formaldehyde or paraformaldehyde and about 0.5 to 2 moles of the second adduct, using the condensation conditions as disclosed, e.g., in U.S. Pat. Nos. 3,442,808; 3,649,229; and 3,798,165 (the disclosures which are hereby incorporated by reference in their entirety). Such Mannich condensation products may include a long chain, high molecular weight hydrocarbon on the phenol group or may be reacted with a compound containing such a hydrocarbon, e.g., polyalkenyl succinic anhydride as shown in said aforementioned U.S. Pat. No. 3,442,808.

The optionally substituted hydroxy aromatic compounds used in the preparation of the Mannich base products include those compounds having the formula $$R^{21}{}_y\text{—Ar—(OH)}_z$$

wherein Ar represents

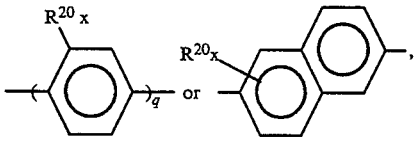

wherein q is 1 or 2, $R^{21}$ is a long chain hydrocarbon, $R^{20}$ is a hydrocarbon or substituted hydrocarbon radical having from 1 to about 3 carbon atoms or a halogen radical such as the bromide or chloride radical, y is an integer from 1 to 2, x is an integer from 0 to 2, and z is an integer from 1 to 2.

Illustrative of such Ar groups are phenylene, biphenylene, naphthylene and the like.

The long chain hydrocarbon $R^{21}$ substituents are olefin polymers as described above for those olefin polymers useful in forming reactants.

Representative hydrocarbyl substituted hydroxy aromatic compounds contemplated for use in the present invention include, but are not limited to, 2-polypropylene phenol, 3-polypropylene phenol, 4-polypropylene phenol, 2-polybutylene phenol, 3-polyisobutylene phenol, 4-polyisobutylene phenol, 4-polyisobutylene-2-chlorophenol, 4-polyisobutylene-2-methylphenol, and the like.

Suitable hydrocarbyl-substituted polyhydroxy aromatic compounds include the polyolefin catechols, the polyolefin resorcinols, and the polyolefin hydroquinones, e.g., 4-polyisobutylene-1,2-dihydroxybenzene, 3-polypropylene-1,2-dihydroxybenzene, 5-polyisobutylene-1,3-dihydroxybenzene, 4-polyamylene-1,3-dihydroxybenzene, and the like.

Suitable hydrocarbyl-substituted naphthols include 1-polyisobutylene-5-hydroxynaphthalene, 1-polypropylene-3-hydroxynaphthalene and the like.

(D) Still another class of long chain hydrocarbyl reactants to form the improved dispersants of this invention are the Mannich base aminophenol-type condensation products as they are known in the art. Such Mannich condensation products generally are prepared by reacting about 1 mole of long chain hydrocarbon substituted mono and dicarboxylic acids or their anhydrides (e.g., polyisobutylene-substituted succinic anhydride) with an about 1 mole of amine-substituted hydroxy aromatic compound (e.g., aminophenol), which aromatic compound can also be halogen- or hydrocarbyl-sustituted, to form a long chain hydrocarbon substituted amide or imide-containing phenol intermediate adduct (generally having a number average molecular weight of 700 or greater), and condensing about a molar proportion of the long chain hydrocarbon substituted amide- or imide-containing phenol intermediate adduct with about 1 to 2.5 moles of formaldehyde and about 0.5 to 2 moles of the second adduct of this invention.

Suitable aminophenols include 2-aminophenol, 3-aminophenol, 4-aminophenol, 4-amino-3-methylphenol, 4-amino-3-chlorophenol, 4-amino-2-bromophenol and 4-amino-3-ethylphenol.

The preparation and use of the hydroxy aromatic compounds and amino-substituted hydroxy aromatic compounds, and methods useful for reaction thereof with an aldehyde and the selected second adduct of this invention are as described in U.S. Pat. Nos. 4,820,432 and 4,828,742, the disclosures of which are hereby incorporated herein in their entirety.

PREPARATION OF THE DISPERSANT (A) The second adduct (e.g., the branched amidoamine oligomers) is readily reacted with the selected polymer substituted mono- or dicarboxylic acid material, e.g. alkenyl succinic anhydride, by heating an oil solution containing 5 to 95 wt. % of the polymer substituted dicarboxylic acid material to about 100° to 250° C., preferably 125° to 175° C., generally for 1 to 10, e.g. 2 to 6 hours until the desired amount of water is removed. The heating is preferably carried out to favor formation of imides and/or amides, rather than salts. Generally from 1 to 5, preferably from about 1.5 to 3 moles of mono- or dicarboxylic acid moiety content (e.g., grafted maleic anhydride or grafted acrylic acid content) is used per reactive nitrogen equivalent (preferably per equivalent of primary nitrogen) of the second adduct.

An example of the reaction of a second adduct with a polymer-substituted dicarboxylic acid producing reactant is the reaction of polyisobutylene (PIB)-substituted succinic anhydride (PIBSA) with a second adduct having three terminal —$NH_2$ groups, which can be illustrated as follows:

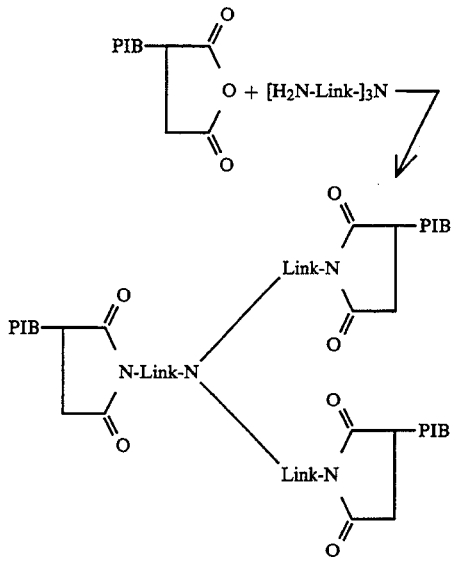

where "Link" is the moiety: —$(C_2H_4NH)_x$-$C(O)C_2H_4(NHC_2H_4)_x$—, wherein x is an integer of from 0 to 10, preferably from 2 to 6.

An example of the reaction of a second adduct with a polymer-substituted monocarboxylic acid producing reactant is the reaction of polyisobutylene propionic acid (PIBA) with a second adduct having 3 terminal —$NH_2$ groups, which can be illustrated as follows:

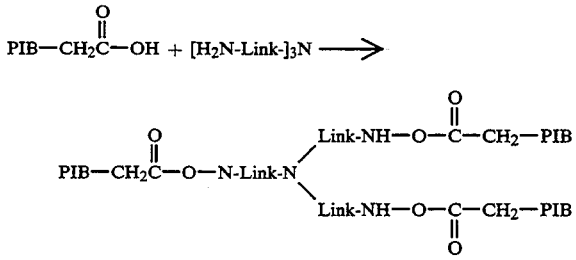

wherein "Link" and x are as defined above.

It will be understood that the second adduct can be employed alone or in admixture with any of the above described amines, such as the polyalkylene polyamines, useful in preparing the second adduct.

Preferably, the polymer substituted mono- or dicarboxylic acid producing material and amido-amine will be contacted for a time and under conditions sufficient to react substantially all of the primary nitrogens in the second adduct reactant. The progress of this reaction can be followed by infra-red analysis.

The dispersant-forming reaction can be conducted in a polar or non-polar solvent (e.g., xylene, toluene, benzene and the like), and is preferably conducted in the presence of a mineral or synthetic lubricating oil.

The nitrogen-containing dispersant materials of the instant invention as described above can be post-treated by contacting said nitrogen-containing dispersant materials with one or more post-treating reagents selected from the group consisting of carbon disulfide, sulfur, sulfur chlorides, alkenyl cyanides, aldehydes, ketones, urea, thio-urea, guanidine, dicyanodiamide, hydrocarbyl phosphates, hydrocarbyl phosphites, hydrocarbyl thiophosphates, hydrocarbyl thiophosphites, phosphorus sulfides, phosphorus oxides, phosphoric acid, hydrocarbyl thiocyanates, hydrocarbyl isocyanates, hydrocarbyl isothiocyantes, epoxides, episulfides, formaldehyde or formaldehyde-producing compounds plus phenols, and sulfur plus phenols, and $C_1$ to $C_{30}$ hydrocarbyl substituted succinic acids and anhydrides (e.g., succinic anhydride, dodecyl succinic anhydride and the like), fumaric acid, itaconic acid, maleic acid, maleic anhydride, chloromaleic acid, chloromaleic anhydride, acrylic acid, methacrylic acid, crotonic acid, cinnamic acid, and lower alkyl (e.g., $C_1$ to $C_4$ alkyl) acid esters of the foregoing, e.g., methyl maleate, ethyl fumarate, methyl fumarate, and the like.

Since post-treating processes involving the use of these post-treating reagents is known insofar as application to high molecular weight nitrogen containing diseprsants of the prior art, further descriptions of these processes herein is unnecessary. In order to apply the prior art processes to the compositions of this invention, all that is necessary is that reaction conditions, ratio of reactants, and the like as described in the prior art, be applied to the novel compositions of this invention. The following U.S. patents are expressly incorporated herein by reference for their disclosure of post-treating processes and post-treating reagents applicable to the compositions of this invention: U.S. Pat. Nos. 3,087,936; 3,200,107; 3,254,025; 3,256,185; 3,278,550; 3,281,428; 3,282,955: 3,284,410; 3,338,832, 3,344,069; 3,366,569; 3,373,111: 3,367,943; 3,403,102; 3,428,561; 3,502,677; 3,513,093; 3,533,945; 3,541,012; 3,639,242; 3,708,522; 3,859,318; 3,865,813; 3,470,098; 3,369,021; 3,184,411; 3,185,645; 3,245,908; 3,245,909; 3,245,910; 3,573,205; 3,692,681; 3,749,695; 3,865,740; 3,954,639; 3,458,530; 3,390,086; 3,367,943; 3,185,704, 3,551,466; 3,415,750; 3,312,619; 3,280,034; 3,718,663; 3,652,616; UK Pat. No. 1,085,903; UK Pat. No. 1,162,436; U.S. Pat. No. 3,558,743.

The nitrogen containing dispersant materials of this invention can also be treated with polymerizable lactones (such as epsilon-caprolactone) to form dispersant adducts having the moiety —$[C(O)(CH_2)_zO]_mH$, wherein z is a number of from 4 to 8 (e.g., 5 to 7) and m has an average value of from about 0 to 100 (e.g., 0.2 to 20) . The dispersants of this invention can be post-treated with a $C_5$ to $C_9$ lactone, (e.g., $C_6$ to $C_9$ lactone, such as epsilon-caprolactone) by heating a mixture of the dispersant material and lactone in a reaction vessel in the absence of a solvent at a temperature of about 50° C. to about 200° C., more preferably from about 75° C. to about 180° C., and most preferably from about 90° C. to about 160° C., for a sufficient period of time to effect reaction. Optionally, a solvent for the lactone, dispersant material and/or the resulting adduct may be employed to control viscosity and/or the reaction rates.

In one preferred embodiment, the $C_5$ to $C_9$ lactone, e.g., epsilon-caprolactone, is reacted with a dispersant material in a 1:1 mole ratio of lactone to dispersant material. In practice, the ratio of factone to dispersant material may vary considerably as a means of controlling the length of the sequence of the lactone units in the adduct. For example, the mole ratio of the lactone to the dispersant material may vary from about 10:1 to about 0.1:1, more preferably from about 5:1 to about 0.2:1, and most preferably from about 2:1 to about 0.4:1.

It is preferable to maintain the average degree of polymerization of the lactone monomer below about 100, with a degree of polymerization on the order of from about 0.2 to about 50 being preferred, and from about 0.2 to about 20 being more preferred. For optimum dispersant performance, sequences of from about 1 to about 5 lactone units in a row are preferred.

Catalysts useful in the promotion of the lactone-dispersant material reactions are selected from the group consisting of stannous octanoate, stannous hexanoate, tetrabutyl titanate, a variety of organic based acid catalysts and amine catalysts, as described on page 266, and forward, in a book chapter authored by R. D. Lundberg and E. F. Cox, entitled "Kinetics and Mechanisms of Polymerization: Ring Opening Polymerization", edited by Frisch and Reegen, published by Marcel Dekker in 1969, wherein stannous octanoate is an especially preferred catalyst. The catalyst is added to the reaction mixture at a concentration level of about 50 to about 10,000 parts per weight of catalyst per one million parts of the total reaction mixture.

The reactions of such lactones with dispersant materials containing nitrogen or ester groups is more completely described in copending applications Ser. Nos. 916,108; 916,217; 916,218; 916,287; 916,303; 916,113; and 916,114, all filed on Oct. 7, 1986; and co-pending Ser. No. 178,099 filed on Apr. 6, 1988; the disclosure of each of which is hereby incorporated by reference in its entirety.

The nitrogen-containing dispersant materials of this invention can also be post-treated by reaction with an alkyl acetoacetate or alkyl thioacetate of the formula:

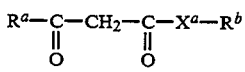

wherein $X^a$ is O or S, $R^b$ is H or $R^a$, and $R^a$ is in each instance in which it appears independently selected from the group consisting of substituted and unsubstituted alkyl or aryl (preferably alkyl of 1 to 6 carbon atoms, e.g., methyl, ethyl, etc.) to form an amino compound N-substituted by at least one tautomeric substituent of the formula:

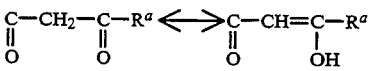

wherein $R^a$ is as defined above.

The reaction is preferably effected at a temperature sufficiently high so as to substantially minimize the production of the enaminone and produce, instead, the keto-enol tautomer. Temperatures of at least about 150° C. are preferred to meet this goal although proper choice of temperature depends on many factors, including reactants, concentration, reaction solvent choice, etc. Temperatures of from about 120° C. to 220° C., preferably from about 150° C. to 180° C. will generally be used. The reaction of the nitrogen-containing dispersant material and the alkyl acetonate and the alkyl thioacetate will liberate the corresponding $HOR^b$ and $HSR^b$ by-products, respectively. Preferably, such by-products are substantially removed, as by distilltion or stripping with an inert gas (such as $N_2$), prior to use of the thus prepared dispersant adduct. Such distillation and stripping steps are conveniently performed at elevated temperature, e.g., at the selected reaction temperature (for example, at 150° C. or higher). A neutral diluent such as mineral oil may be used for the reaction.

The amount of alkyl aceto-acetate and/or alkyl thioacetate reactants used can vary widely, and is preferably selected so as to avoid substantial excesses of these reactants. Generally, these reactants are used in a reactant: amine nitrogen-equivalent molar ratio of from about 0.1 to 1:1, and preferably from about 0.5 to 1:1, wherein the moles of amine nitrogen-equivalent is the moles of secondary nitrogens plus twice the moles of primary nitrogens in the nitrogen-containing dispersant material (e.g., polyisobutenyl succinimide) which is thus contacted with the alkylacetonate or alkyl thioacetate. The reaction should also be conducted in the substantial absence of strong acids (e.g., mineral acids, such as HCl, $HB_2$, $H_2SO_4$, $H_3PO_3$ and the like, and sulfonic acids, such as para-toluene sulfonic acids) to avoid the undesired side-reactions and decrease in yield to the adducts of this invention.

The reactions of such alkyl acetoacetates and thioacetoacetates with nitrogen-containing dispersant materials is more completely described in copending application Ser. No. 51,276, filed May 18, 1987, the disclosure of which is hereby incorporated by reference in its entirety.

Further aspects of the present invention reside in the formation of metal complexes of the novel dispersant additives prepared in accordance with this invention. Suitable metal complexes may be formed in accordance with known techniques of employing a reactive metal ion species during or after the formation of the present dispersant materials. Complex forming metal reactants include the metal nitrates, thiocyanates, halides, carboxylates, phosphates, thio-phosphates, sulfates, and borates of transition metals such as iron, cobalt, nickel, copper, chromium, manganese, molybdenum, tungsten, ruthenium, palladium, platinum, cadmium, lead, silver, mercury, antimony and the like. Prior art disclosures of these complexing reactions may be also found in U.S. Pat. Nos. 3,306,908 and Re. 26,433, the disclosures of which are hereby incorporated by reference in their entirety.

The processes of these incorporated patents, as applied to the compositions of this invention, and the post-treated compositions thus produced constitute a further aspect of this invention.

The dispersant-forming reaction can be conducted in a polar or non-polar solvent (e.g., xylene, toluene, benzene and the like), and is preferably conducted in the presence of a mineral or synthetic lubricating oil.

The nitrogen containing dispersants can be further treated by boration as generally taught in U.S. Pat. Nos. 3,087,936 and 3,254,025 (incorporated herein by reference thereto). This is readily accomplished by treating the selected acyl nitrogen dispersant with a boron compound selected from the class consisting of boron oxide, boron halides, boron acids and esters of boron acids in an amount to provide from about 0.1 atomic proportion of boron for each mole of said acylated nitrogen composition to about 20 atomic proportions of boron for each atomic proportion of nitrogen of said acylated nitrogen composition. Usefully the dispersants of the inventive combination contain from about 0.05 to 2.0 wt. %, e.g. 0.05 to 0.7 wt. % boron based on the total weight of said borated acyl nitrogen compound. The boron, which appears to be in the product as dehydrated boric acid polymers (primarily $(HBO_2)_3$), is believed to attach to the dispersant imides and diimides as amine salts, e.g., the metaborate salt of said diimide.

Treating is readily carried out by adding from about 0.05 to 4, e.g. 1 to 3 wt. % (based on the weight of said acyl nitrogen compound) of said boron compound, preferably boric acid which is most usually added as a slurry to said acyl nitrogen compound and heating with stirring at from about 135° C. to 190°, e.g. 140°–170° C., for from 1 to 5 hours followed by nitrogen stripping at said temperature ranges. Or, the boron treatment can be carried out by adding boric acid to the hot reaction mixture of the monocarboxylic acid material and amine while removing water.

The ashless dispersants of this invention can be used alone or in admixture with other dispersants such as esters derived from the aforesaid long chain hydrocarbon substituted dicarboxylic acid material and from hydroxy compounds such as monohydric and polyhydric alcohols or aromatic compounds such as phenols and naphthols, etc. The polyhydric alcohols are the most preferred hydroxy compound and preferably contain from 2 to about 10 hydroxy radicals, for example, ethylene glycol, diethylene glycol, triethylene glycol, tetraethylene glycol, dipropylene glycol, and other alkylene glycols in which the alkylene radical contains from 2 to about 8 carbon atoms. Other useful polyhydric alcohols include glycerol, mono-oleate of glycerol, monostearate of glycerol, monomethyl ether of glycerol, pentaerythritol, dipentaerythritol, and mixtures thereof.

The ester dispersant may also be derived from unsaturated alcohols such as allyl alcohol, cinnamyl alcohol, propargyl alcohol, 1-cyclohexane-3-ol, and oleyl alcohol. Still other classes of the alcohols capable of yielding the esters of this invention comprise the ether-alcohols and amino-alcohols including, for example, the oxy-alkylene, oxy-arylene-, amino-alkylene-, and amino-arylene-substituted alcohols having one or more oxy-alkylene, amino-alkylene or amino-arylene oxy-arylene radicals. They are exemplified by Cellosolve, Carbitol, N, N, N', N'-tetrahydroxy-trimethylene diamine, and ether-alcohols having up to about 150 oxy-alkylene radicals in which the alkylene radical contains from 1 to about 8 carbon atoms.

The ester dispersant may be di-esters of succinic acids or acidic esters, i.e., partially esterified succinic acids; as well as partially esterified polyhydric alcohols or phenols, i.e., esters having free alcohols or phenolic hydroxyl radicals. Mixtures of the above illustrated esters likewise are contemplated within the scope of this invention.

The ester dispersant may be prepared by one of several known methods as illustrated for example in U.S. Pat. No. 3,381,022. The ester dispersants may also be borated, similar to the nitrogen containing dispersants, as described above.

Hydroxyamines which can be reacted with the aforesaid long chain hydrocarbon substituted dicarboxylic acid materials to form dispersants include 2-amino-1-butanol, 2-amino-2-methyl-1-propanol, p-(beta-hydroxyethyl) -aniline, 2-amino-1-propanol, 3-amino-1-propanol, 2-amino-2-methyl-1,3-propane-diol, 2-amino-2-ethyl-1, 3-propanediol, N-(beta-hydroxy-propyl) -N'-(beta-aminoethyl ) -piperazine, tris(hydroxymethyl) amino-methane (also known as trismethylolaminomethane), 2-amino-1-butanol, ethanolamine, beta- (beta-hydroxyethoxy) ethylamine, and the like. Mixtures of these or similar amines can also be employed. The above description of nucleophilic reactants suitable for reaction with the hydrocarbyl substituted dicarboxylic acid or anhydride includes amines, alcohols, and compounds of mixed amine and hydroxy containing reactive functional groups, i.e., amino-alcohols.

The tris (hydroxymethyl) amino methane (THAM) can be reacted with the aforesaid acid material to form amides, imides or ester type additives as taught by U.K. 984,409, or to form oxazoline compounds and borated oxazoline compounds as described, for example, in U.S. Pat. Nos. 4,102,798; 4,116,876 and 4,113,639.

Other dispersants which can be employed in admixture with the novel dispersants of this invention are those derived from the aforesaid long chain hydrocarbyl substituted dicarboxylic acid material and the aforesaid amines, such as polyalkylene polyamines, e.g., long chain hydrocarbyl substituted succinimides. Exemplary of such other dispersants are those described in co-pending Ser. No. 95,056, filed Sep. 9, 1987.

A preferred group of ashless dispersants are those derived from polyisobutylene substituted with succinic anhydride groups and reacted with second adducts, containing on average at least 6 (e.g., from 6 to 30) reactive nitrogen moieties and from 2 to 4 primary nitrogen groups per molecule, formed by reacting polyethylene amines, e.g., tetraethylene pentamine, pentaethylene hexamine, polyoxyethylene and polyoxypropylene amines, e.g., polyoxypropylene diamine, trismethylolaminomethane and pentaerythritol, and combinations thereof, with a branched first adduct prepared by reacting ammonia or a diprimary amine having from 2 to 12 total nitrogen atoms and from 2 to 30 carbon atoms per molecule with an acrylate-type compound of formula (IX) above, and most preferably with an acrylate-type reactant selected from the group consisting of lower alkyl alky-acrylates (e.g., methyl, ethyl, iso-propyl, propyl, iso-butyl, n-butyl, tert-butyl, etc., esters of methacrylic acid, acrylic acid, and the like).

The dispersants of the present invention can be incorporated into a lubricating oil (or a fuel in any convenient way. Thus, these mixtures can be added directly to the lubricating oil (or fuel) by dispersing or dissolving the same in the lubricating oil (or fuel) at the desired level of concentration of the dispersant. Such blending into the additional lubricating oil (or fuel) can occur at room temperature or elevated temperatures. Alternatively, the dispersants can be blended with a suitable oil-soluble solvent/diluent (such as benzene, xylene, toluene, lubricating base oils and petroleum distillates, including the various normally liquid fuels described in detail below) to form a concentrate, and then blending the concentrate with a lubricating oil (or fuel) to obtain the final formulation. Such dispersant concentrates will typically contain (on an active ingredient (A.I.) basis) from about 3 to about 45 wt. %, and preferably from about 10 to about 35 wt. %, dispersant additive, and typically from about 30 to 90 wt. %, preferably from about 40 to 60 wt. %, base oil, based on the concentrate weight.

OLEAGINOUS COMPOSITIONS

The additive mixtures of the present invention possess very good dispersant properties as measured herein in a wide variety of environments. Accordingly, the additive mixtures are used by incorporation and dissolution into an oleaginous material such as fuels and lubricating oils. When the additive mixtures of this invention are used in normally liquid petroleum fuels such as middle distillates boiling from about 65° to 430° C., including kerosene, diesel fuels, home heating fuel oil, jet fuels, etc., a concentration of the additives in the fuel in the range of typically from about 0.001 to about 0.5, and preferably 0.005 to about 0.15 weight percent, based on the total weight of the composition, will usually be employed. The properties of such fuels are well known as illustrated, for example, by ASTM Specifications D #396-73 (Fuel Oils) and D #439-73 (Gasolines) available from the American Society for Testing Materials ("ASTM"), 1916 Race Street, Philadelphia, Pa. 19103.

The fuel compositions of this invention can contain, in addition to the products of this invention, other additives which are well known to those of skill in the art. These can include anti-knock agents such as tetraalkyl lead compounds, lead scavengers such as haloalkanes, deposit preventers or modifiers such as triaryl phosphates, dyes, cetane improvers, anitoxidants such as 2,6-ditertiary-butyl-4-methylphenol, rust inhibitors, bacteriostatic agents, gum inhibitors, metal deactivators, upper cylinder lubricants and the like.

The additive mixtures of the present invention find their primary utility in lubricating oil compositions which employ a base oil in which the additives redissolved or dispersed. Such base oils may be natural or synthetic. Base oils suitable for use in preparing the lubricating oil compositions of the present invention include those conventionally employed as crankcase lubricating oils for spark-ignited and compression-ignited internal combustion engines, such as automobile and truck engines, marine and railroad diesel engines, and the like. Advantageous results are also achieved by employing the additive mixtures of the present invention in base oils conventionally employed in and/or adapted for use as power transmitting fluids, universal tractor fluids and hydraulic fluids, heavy duty hydraulic fluids, power steering fluids and the like. Gear lubricants, industrial oils, pump oils and other lubricating oil compositions can also benefit from the incorporation therein of the additive mixtures of the present invention.

These lubricating oil formulations conventionally contain several different types of additives that will supply the characteristics that are required in the formulations. Among these types of additives are included viscosity index improvers, antioxidants, corrosion inhibitors, detergents, dispersants, pour point depressants, antiwear agents, friction modifiers, etc. as described in U.S. Pat. No. 4,797,219, the disclosure of which is hereby incorporated by reference in its entirety. Some of these numerous additives can provide a multiplicity of effects, e.g. a dispersant-oxidation inhibitor. This approach is well known and need not be further elaborated herein.

In the preparation of lubricating oil formulations it is common practice to introduce the additives in the form of 10 to 80 wt. %, e.g., 20 to 80 wt. % active ingredient concentrates in hydrocarbon oil, e.g. mineral lubricating oil, or other suitable solvent. Usually these concentrates may be diluted with 3 to 100, e.g., 5 to 40 parts by weight of lubricating oil, per part by weight of the additive package, in forming finished lubricants, e.g. crankcase motor oils. The purpose of concentrates, of course, is to make the handling of the various materials less difficult and awkward as well as to facilitate solution or dispersion in the final blend. Thus, a dispersant would be usually employed in the form of a 40 to 50 wt. % concentrate, for example, in a lubricating oil fraction.

The ashless dispersants of the present invention will be generally used in admixture with a lube oil basestock, comprising an oil of lubricating viscosity, including natural and synthetic lubricating oils and mixtures thereof.

Natural oils include animal oils and vegetable oils (e.g., castor, lard oil) liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, the alkyl and aryl ethers of these polyoxyalkylene polymers (e.g., methyl-poly isopropylene glycol ether having an average molecular weight of 1000, diphenyl ether of poly-ethylene glycol having a molecular weight of 500–1000, diethyl ether of polypropylene glycol having a molecular weight of 1000–1500); and mono- and polycarboxylic esters thereof, for example, the acetic acid esters, mixed $C_3$–$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids ) with a variety of alcohols (e.g., butyl alcohol, hexyl alcohol, dodecyl alcohol, 2-ethylhexyl alcohol, ethylene glycol, diethylene glycol monoether, propylene glycol) . Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol and tripentaerythritol.

Silicon-based oils such as the polyalkyl-, polyaryl-, polyalkoxy-, or polyaryloxysiloxane oils and silicate oils comprise another useful class of synthetic lubricants; they include tetraethyl silicate, tetraisopropyl silicate, tetra-(2-ethylhexyl) silicate, tetra- (4-methyl-2-ethylhexyl) silicate, tetra-(p-tertbutylphenyl ) silicate, hexa-(4-methyl-2-pentoxy) disiloxane, poly (methyl) siloxanes and poly(methylphenyl) siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

Unrefined, refined and rerefined oils can be used in the lubricants of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art. Rerefined oils are obtained by processes similar to those used to obtain refined oils applied to refined oils which have been already used in service. Such rerefined oils are also known as reclaimed or reprocessed oils and often are additionally processed by techniques for removal of spent additives and oil breakdown products.

Compositions when containing these conventional additives are typically blended into the base oil in amounts effective to provide their normal attendant function. Representative effective amounts of such additives (as the respective active ingredients) in the fully formulated oil are illustrated as follows:

| Compositions | Wt. % A.I. (Preferred) | Wt. % A.I. (Broad) |
|---|---|---|
| Viscosity Modifier | .01-4 | 0.01-12 |
| Detergents | 0.01-3 | 0.01-20 |
| Corrosion Inhibitor | 0.01-1.5 | .01-5 |
| Oxidation Inhibitor | 0.01-1.5 | .01-5 |
| Dispersant | 0.1-8 | .1-20 |
| Pour Point Depressant | 0.01-1.5 | .01-5 |
| Anti-Foaming Agents | 0.001-0.15 | .001-3 |
| Anti-Wear Agents | 0.001-1.5 | .001-5 |
| Friction Modifiers | 0.01-1.5 | .01-5 |
| Mineral Oil Base | Balance | Balance |

When other additives are employed, it may be desirable, although not necessary, to prepare additive concentrates comprising concentrated solutions or dispersions of the novel dispersants of this invention (in concentrate amounts hereinabove described), together with one or more of said other additives (said concentrate when constituting an additive mixture being referred to herein as an additive-package) whereby, several additives can be added simultaneously to the base oil to form the lubricating oil composition. Dissolution of the additive concentrate into the lubricating oil may be facilitated by solvents and by mixing accompanied with mild heating, but this is not essential. The concentrate or additive-package will typically be formulated to contain the additives in proper amounts to provide the desired concentration in the final formulation when the additive-package is combined with a predetermined amount of base lubricant. Thus, the dispersants of the present invention can be added to small amounts of base oil or other compatible solvents along with other desirable additives to form additive-packages containing active ingredients in collective amounts of typically from about 2.5 to about 90%, and preferably from about 15 to about 75%, and most preferably from about 25 to about 60% by weight additives in the appropriate proportions with the remainder being base oil.

The final formulations may employ typically about 10 wt. % of the additive-package with the remainder being base oil.

All of said weight percents expressed herein (unless otherwise indicated) are based on active ingredient (A.I.) content of the additive, and/or upon the total weight of any additive-package, or formulation which will be the sum of the A.I. weight of each additive plus the weight of total oil or diluent.

This invention will be further understood by reference to the following examples, wherein all parts are parts by weight, unless otherwise noted and which include preferred embodiments of the invention.

EXAMPLE 1. Preparation of $NH_3$-Methyl Acrylate First Adduct 8.2 g of ammonia is bubbled into 100 ml of anhydrous methanol at −10° C. This cooled ammonia-methanol solution is added to 296 g of methyl acrylate (MeAc) dropwise under a nitrogen atmosphere with external cooling to keep the liquid reaction mixture at a temperature of from about 20°-25° C. After the addition is completed, the reaction mixture is allowed to stir at room temperature overnite. The reaction mixture is then stripped with $N_2$ gas to remove the excess methylacrylate and methanol until constant weight. The product analyzes for 52.3 wt. % C, 7.89 wt. % H and 4.5 wt. % N (theoretical 52.4 wt. % C, 7.6. wt. % H, 5.1 wt. % N).

EXAMPLE 2. Preparation of $NH_3$-MeAc+TETA Second Adduct 55 g (0.2 mole ) of the product of Example 1 is charged into a-reaction flask and diluted with 100 ml of anhydrous isopropanol. While stirring and under $N_2$ atmosphere, 87.6 g (0.6 mole) of triethylenetetramine (TETA) is added and heated to 100° C. while nitrogen sparging for about 10 hours. When the infrared analysis indicates complete disappearance of the ester band, the reaction mixture is stripped at 100° C. for one half hour and the product collected. It analyzes for 27.2 wt. % N and 4.21 milliequivalents of primary nitrogen per gram of sample.

EXAMPLE 3. Preparation of $NH_3$-MeAc+PAM Second Adduct

The procedure of Example 2 is followed except that 27.5 g (0.1 mole) of the ammonia-methyl acrylate first adduct and 70.6 g (0.6 milliequivalent of primary nitrogen) of poly(ethyleneamine) having an average of 5 to 7 nitrogen atoms per molecule (PAM) are used. The product analyzes for 27.6 wt. % N and 3.38 milliequivalents of primary nitrogen per gram of sample.

EXAMPLE 4. Preparation of $NH_3$-MeAc-TETA+PIBSA Dispersant

About 300 g (0. I mole) of a polyisobutenyl succinic anhydride derived from a $\overline{M}_n$ 2225 polyisobutylene ($\overline{M}_w/\overline{M}_n=2.5$) and having a saponification number of 37.4 (67.7% active ingredient) is charged into a reaction flask with 127 g S150N and heated to 150° C. while stirring under nitrogen blanket. Then 23.2 g (0.1 equivalents of primary nitrogen) of the second adduct prepared in Example 2 is added slowly for about one half hour. The reaction mixture is heat soaked while stirring and nitrogen stripping for 3 hours. The oil solution containing the dispersant is filtered while hot and evaluated. It is found to have a kinematic viscosity of 341 cSt at 100° C. and contains 1.52 wt. % N.

EXAMPLE 5. Preparation of $NH_3$-MeAc-PAM+PIBSA Dispersant

The procedure of Example 4 is repeated except that 29.6 g (0.1 equivalents of primary nitrogen) of the adduct of Example 3 and 300 g of the PIBSA are used. The filtered oil solution is found to have a kinematic viscosity of 490 cSt at 100° C. and 1.81 wt. % N.

EXAMPLE 6. Preparation of DETA-Methylacrylate First Adduct

Using the procedure of Example 1, 51.5 g (0.5 mole ) of diethylene triamine (DETA) is charged into a reaction flask and diluted with 100 ml of anhydrous isopropanol. Then 258 g (3 mole) of methyl acrylate is added at a rate to keep the reaction temperature below 30° C. When the addition is completed, the reaction mixture is stirred at room temperature overnight. The reaction mixture is stripped with a $N_2$ gas stream until constant weight and the product analyzes for 54.17 wt. % C, 8.67 wt. % H and 7.74 wt. % N (theoretical 54.0 wt. % C, 8.1 wt. % H, 7.8 wt. % N).

EXAMPLE 7. Preparation of MeAc-DETA+TETA Second Adduct

The procedure of Example 2 is repeated except that 53.3 g (0.1 mole) of the methyl-acrylate-DETA adduct of Example 6 and 73 g (0.5 mole) of triethylenetetramine (TETA) are used. The product analyzes for 28 wt. % N and 3.88 milliequivalents of primary nitrogen per gram of sample.

EXAMPLE 8. Preparation of MeAc-DETA+PAM Second Adduct

The procedure of Example 7 is followed except that 53.3 g of the adduct of Example 6 and 117 g of PAM are used. The product analyzes for 28.2 wt. % N and 3.33 milliequivalent of primary nitrogen per gram of sample.

EXAMPLE 9. Preparation of MeAc-DETA-TETA+PIBSA Dispersant

The procedure of Example 4 is carried out except that 12.9 g (0.05 equivalents of primary nitrogen) of the product of Example 7, 150 g of PIBSA and 64.5 g of S150N are used. The filtered oil solution has a kinematic viscosity of 300 cSt at 100° C. and 1.59 wt. % N.

EXAMPLE 10. Preparation of MeAc-DETA-PAM+PIBSA Dispersant

The procedure of Example 4 is repeated except that 15 g (0.05 equivalents of primary nitrogen) of the product of Example 8, 150 g of PIBSA and 67 g of S150N are used. The filtered oil solution analyzes for a kinematic viscosity of 592 cSt at 100° C. and 1.83 wt. % N.

COMPARATIVE EXAMPLE A. Preparation of PIBSA-TEPA Dispersant

The procedure of Example 4 is repeated except that 150 g (0.05 mole) of PIBSA, 3.65 g (0.025 mole) of triethylenetetramine and 56 g of S150N are used. The filtered oil solution analyzes for 0.67 % wt. N and has a kinematic viscosity of 381 cSt at 100° C.

COMPARATIVE EXAMPLE B. Preparation of PIBSA-PAM Dispersant

The procedure of Example 4 is repeated except that 150 g (0.05 mole) of PIBSA, 5.85 g (0.05 equivalents of primary nitrogen) and 58 g of S150N are used. The filtered oil solution analyzes for 0.91 wt. % N and a kinematic viscosity of 450 cSt at 100° C.

The product dispersants thereby obtained are summarized as set forth in Table I below.

TABLE I

| Example No. | PIB Mn | Amine | wt % N | VIS 100° C., cSt(1) |
|---|---|---|---|---|
| 4 | 2225 | Ex. 2 Product | 1.52 | 341 |
| 5 | " | Ex. 3 Product | 1.81 | 490 |
| 9 | " | Ex. 4 Product | 1.59 | 300 |
| 10 | " | Ex. 8 Product | 1.83 | 592 |
| Comp. A | " | TETA | 0.67 | 381 |
| Comp. B | " | PAM | 0.91 | 450 |

(1)kinematic viscosity.

The following lubricating oil compositions are prepared using the dispersants of Examples 4, 5, 9, 10, and Comparative Examples A–B. The resulting compositions are then tested for sludge inhibition (via the SIB test) and varnish inhibition (via the VIB test), as described below.

The SIB test has been found, after a large number of evaluations, to be an excellent test for assessing the dispersing power of lubricating oil dispersant additives.

The medium chosen for the SIB test is a used crankcase mineral lubricating oil composition having an original viscosity of about 325 SUS at 38° C. that had been used in a taxicab that is driven generally for short trips only, thereby causing a buildup of a high concentration of sludge precursors. The oil that is used contained only a refined base mineral lubricating oil, a viscosity index improver, a pour point depressant and zinc dialkyldithiophosphate anti-wear additive. The oil contained no sludge dispersant. A quantity of such used oil is acquired by draining and refilling the taxicab crankcase at 1000–2000 mile intervals.

The SIB test is conducted in the following manner: the aforesaid used crankcase oil, which is milky brown in color, is freed of sludge by centrifuging for one hour at about 39,000 gravities (gs.). The resulting clear bright red supernatant oil is then decanted from the insoluble sludge particles thereby separated out. However, the supernatant oil still contains oil-soluble sludge precursors which on heating under the conditions employed by this test will tend to form additional oil-insoluble deposits of sludge. The sludge inhibiting properties of the additives being tested are determined by adding to portions of the supernatant used oil, a small amount, such as 0.5, 1 or 2 weight percent, of the particular additive being tested. Ten grams of each blend being tested are placed in a stainless steel centrifuge tube and are heated at 135° C. for 16 hours in the presence of air. Following the heating, the tube containing the oil being tested is cooled and then centrifuged for about 30 minutes at room temperature at about 39,000 gs. Any deposits of new sludge that form in this step are separated from the oil by decanting the supernatant oil and then carefully washing the sludge deposits with 25 ml of heptane to remove all remaining oil from the sludge and further centrifuging. The weight of the new solid sludge that has been formed in the test, in milligrams, is determined by drying the residue and weighing it. The results are reported as amount of precipitated sludge in comparison with the precipitated sludge of a blank not containing any additional additive, which blank is normalized to a rating of 10. The less new sludge precipitated in the presence of the additive; the lower the SIB value and the more effective is the additive as a sludge dispersant. In other words, if the additive gives half as much precipitated sludge as the blank, then it would be rated 5.0 since the blank will be normalized to 10.

The VIB test is used to determine varnish inhibition. Here, each test sample consisted of 10 grams of lubricating oil containing a small amount of the additive being tested. The test oil to which the additive is admixed is of the same type as used in the above-described SIB test. Each ten gram sample is heat soaked overnight at about 140° C. and thereafter centrifuged to remove the sludge. The supernatant fluid of each sample is subjected to heat cycling from about 150° C. to room temperature over a period of 3.5 hours at a frequency of about 2 cycles per minute. During the heating phase, gas which is a mixture of about 0.7 volume percent $SO_2$, 1.4 volume percent NO and balance air is bubbled through the test samples. During the cooling phase, water vapor is bubbled through the test samples. At the end of the test period, which testing cycle can be repeated as necessary to determine the inhibiting effect of any additive, the wall surfaces of the test flasks in which the samples are contained are visually evaluated as to the varnish inhibition. The amount of varnish imposed on the walls is rated to values of from 1 to 11 with the higher number being the greater amount of varnish, in comparison with a blank with no additive that is rated 11.

10.00 grams of SIB test oil are mixed with 0.05 grams of the products of the Examples as described in Table I and tested in the aforedescribed SIB and VIB tests. The data thereby obtained are summarized in Table II below.

TABLE II

| Dispersant Example No. | Amine | Wt. % N | SIB | VIB |
|---|---|---|---|---|
| 4 | $NH_3$-MeAc + TETA | 1.52 | 1.3 | 3 |
| 5 | $NH_3$-MeAc + PAM | 1.81 | 1.58 | 3 |
| 9 | DETA-MeAc + TETA | 1.59 | 0.22 | 3 |
| 10 | DETA-MeAc + PAM | 1.83 | 1.63 | 3 |
| Comp. A | TETA | 0.67 | 3.59 | 7 |
| Comp. B | PAM | 0.91 | 1.79 | 7 |

The above data thereby obtained show that the dispersants of this invention have excellent SIB/VIB performance and sludge and varnish inhibiting properties.

A series of lubricating formulations were prepared which contained 6 vol % of the novel branched dispersants formed in Examples 4, 5, 9 and 10, respectively. Each lubricating composition also contained mineral lubricating oil, a mixture of overbiased Mg sulfonate detergent inhibitor and overbased Ca sulfonate detergent inhibitor, zinc dialkyl dithiophosphate antiwear agent, antioxidant and ethylene propylene viscosity index improver.

The following Table illustrates preparation of additional first and second adducts employing the present invention.

TABLE III

| | First Adduct (1) | | | | Second Adduct (3) | |
|---|---|---|---|---|---|---|
| Example No. | 1st N Comp'd. | Polyfunctional Reactant | Temp. °C. | DB (2) | Polyamine (4) | Temp. °C. |
| 11 | $NH_3$ | 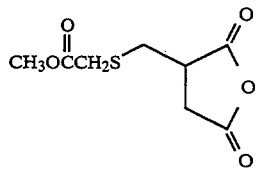 | 25 | 3 | TEPA | 110 |
| 12 | $NH_3$ | $CH_2{=}CH{-}S(O)_2OCH_3$ | 25 | 3 | DETA | 110 |
| 13 | DETA(4) | $CH_3O[C(O)]_2Cl$ | 25 | 5 | TETA | 100 |
| 14 | $NH_3$ | $CH_3C(O)CH_2C(O)OCH_3$ | 25 | 3 | TEPA | 110 |
| 15 | $C_{18}H_{37}NH_2$ | $CH_2{=}CHC(O)OCH_3$ | 25 | 2 | TEPA | 110 |
| 16 | $NH_3$ | 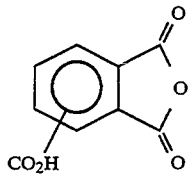 | 25 | 3 | HPHA | 110 |
| 17 | TETA(4) | 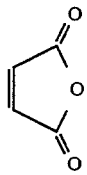 | 25 | 6 | TEPA | 110 |
| 18 | $NH_3$ | $CH_2{=}CHC(O)H$ | 25 | 3 | TEPA | 80 |
| 19 | $NH_3$ | $CH_2{=}CHC(O)NH_2$ | 25 | 3 | TEPA | 110 |
| 20 | EDA(4) | $CH_2CHC(O)OH$ | 25 | 3 | TETA | 100 |
| 21 | $NH_3$ | $CH_2{=}CH{-}CN$ | 25 | 3 | TEPA | 110 |

(1)Exs. 11, 12, 14, 16, 18 and 19-repeat procedure of Example 1 (with 80% molar excess of polyfunctional reactant). Exs. 13, 15, 17 and 20-repeat procedure of Example 6 (with 80% molar excess of polyfunctional reactant).
(2)Degree of branching of first adduct.
(3)First adduct product mixture stripped of excess polyfunctional reactant. Exs. 11-20-repeat procedure of Example 2.
(4)TEPA = tetraethylene pentamine; DETA = diethylene triamine; TETA = triethylene tetramine; HPHA = hexapropylene heptamine; EDA = ethylene diamine.

The principles, preferred embodiments, and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A dispersant additive formed by a process which comprises:

(a) contacting in a first liquid reaction mixture a first nitrogen-containing compound having at least two reactive nitrogen moieties with a polyfunctional reactant having within its structure a first functional group reactive with a —NH— group, in an amount and under conditions sufficient to selectively react at least a portion of the first functional groups in the polyfunctional reactant with the reactive nitrogen moieties to form a first adduct;

(b) contacting the first adduct with a second nitrogen-containing compound having at least two —NH— groups in an amount and under conditions sufficient to react the additional functional groups in the first adduct with the —NH— groups in the second nitrogen-containing compound to form a branched second adduct characterized by having within its structure on average (i) at least two nitrogen-containing moieties derived from the second nitrogen-containing compound per nitrogen-containing moiety derived from the first nitrogen-containing compound and (ii) at least two unreacted primary or secondary amine groups per molecule; and (c) contacting the branched second adduct in a second liquid reaction mixture with an aldehyde and a long chain hydrocarbyl substituted hydroxy aromatic compound; wherein the polyfunctional reactant comprises at least one alpha, beta-unsaturated compound of the formula:

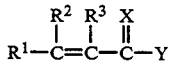

wherein X is sulfur or oxygen, Y is $—OR^4$, $—SR^4$, or $—NR_4(R^5)$, and $R^1$, $R^2$, $R^3$, $R^4$ and $R^5$ are the same or different and are hydrogen or substituted or unsubstituted hydrocarbyl.

2. The dispersant additive of claim 1, wherein the long chain hydrocarbyl substituted hydroxy aromatic compound has the formula:

$$R_y^{21}—Ar—(OH)_z$$

wherein Ar represents

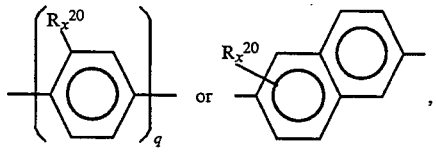

wherein q is 1 or 2; $R^{21}$ is a long chain hydrocarbon; $R^{20}$ is a hydrocarbon or substituted hydrocarbon radical having from 1 to about 3 carbon atoms or a halogen radical; y is an integer from 1 to 2; x is an integer from 0 to 2; and z is an integer from 1 to 2.

3. The dispersant additive of claim 2, wherein $R^{21}$ is an olefin polymer of $C_2$ to $C_{10}$ monoolefin having a number average molecular weight of about 300 to about 10,000.

4. The dispersant additive of claim 3, wherein the olefin polymer has a number average molecular weight of about 700 to about 5,000.

5. The dispersant additive of claim 4, wherein the number average molecular weight is from about 1,300 to about 3,000.

6. The dispersant additive of claim 3, wherein the olefin polymer comprises polyisobutylene of about 700 to 5,000 number average molecular weight; the first nitrogen-containing compound comprises ammonia; the second nitrogen-containing compound comprises polyalkylenepolyamine, wherein each alkylene group contains from 2 to 6 carbons and the polyalkylenepolyamine contains from 5 to 9 nitrogen atoms per molecule; and the alpha, beta-unsaturated compound comprises at least one member selected from the group consisting of methyl acrylate, ethyl acrylate, propyl acrylate, butyl acrylate, methyl methacrylate, ethyl methacrylate, propyl methacrylate, and butyl methacrylate.

7. The dispersant additive of claim 3, wherein the olefin polymer comprises polyisobutylene.

8. The dispersant additive of claim 3, wherein the olefin polymer comprises ethylene-propylene copolymer.

9. The dispersant additive of claim 1, wherein the second nitrogen-containing compound comprises at least one polyamine containing from 2 to 60 carbon atoms and from 2 to 12 nitrogen atoms per molecule.

10. The dispersant additive of claim 9, wherein the polyamine comprises a polyalkylenepolyamine wherein each alkylene group contains from 2 to 6 carbon atoms and the polyalkylenepolyamine contains from 5 to about 9 nitrogen atoms per molecule.

11. The dispersant additive of claim 1, wherein the second nitrogen-containing compound comprises polyethylenepolyamine or polypropylenepolyamine.

12. The dispersant additive of claim 1, wherein the dispersant additive is borated to provide from about 0.05 to 2.0 weight percent boron in the borated dispersant additive.

13. The dispersant additive of claim 1, wherein the second nitrogen-containing compound comprises a polyamine containing an average of at least 2 primary nitrogen atoms per molecule; the polyfunctional reactant comprises at least one $\alpha$, $\beta$-unsaturated compound; and the first nitrogen-containing compound and the $\alpha$, $\beta$-unsaturated compound are contacted in an amount of from about 1.1 to 3 moles of the $\alpha$, $\beta$-unsaturated compound per equivalent of the reactive nitrogen moieties in the first nitrogen-containing compound.

14. The dispersant additive of claim 13, wherein the first adduct is characterized by an average degree of branching of from 3 to 20.

15. The dispersant additive of claim 14, wherein the second adduct contains an average of from 2 to 6 unreacted primary amine groups.

16. The dispersant additive of claim 15, wherein the amido-amine contains an average of from 1 to 3 amido groups per molecule of the amido-amine.

17. A lubricating oil composition containing from about 0.1 to 20 weight percent of the dispersant additive of claim 1.

18. A process for producing a lubricating oil dispersant additive which comprises contacting:

(A) a nitrogen-containing branched adduct characterized by having within its structure on average at least two unreacted primary or secondary amine groups per molecule, the branched adduct being obtained by a process which comprises:

(i) contacting in a first reaction mixture a first nitrogen-containing compound having at least two reactive nitrogen moieties with a polyfunctional reactant having within its structure a first functional group reactive with a —NH— group, and at least one additional functional group reactive with a —NH— group, in an amount and under conditions sufficient to selectively react the first functional groups in the polyfunctional reactant with the reactive nitrogen moieties to form a first adduct; and (ii) contacting the first adduct in a second liquid reaction mixture with a second nitrogen-containing compound having at least two —NH— groups in an amount and under conditions sufficient to react the additional functional groups in the first adduct with the —NH-groups in the second nitrogen-containing compound to form a second adduct comprising the branched adduct, the branched adduct being further characterized by having within its structure on average (i) at least two nitrogen-containing moieties derived from the second nitrogen-containing compound per nitrogen-containing moiety derived from the first nitrogen-containing moiety derived from the first nitrogen-containing compound;

(B) a long chain hydrocarbyl-substituted hydroxy aromatic compound; and (C) at least one aldehyde;

wherein the polyfunctional reactant comprises at least one $\alpha$, $\beta$-unsaturated compound of the formula:

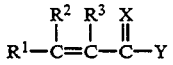

wherein X is sulfur or oxygen; Y is $—OR^4$, $—SR^4$, or $—NR_4(R^5)$; and $R^1$, $R^2$, $R^3$, $R^4$ and $R^5$ are the same or different and are hydrogen or substituted or unsubstituted hydrocarbyl.

19. The process of claim 18, wherein the long chain hydrocarbyl-substituted hydroxy aromatic compound has the formula:

$$R^{21}{}_y—Ar—(OH)_z$$

wherein Ar represents

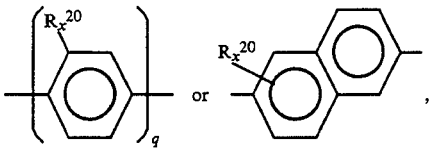

wherein q is 1 or 2; $R^{21}$ is a long chain hydrocarbon; $R^{20}$ is a hydrocarbon or substituted hydrocarbon radical having from 1 to about 3 carbon atoms or a halogen radical; y is an integer from 1 to 2; x is an integer from 0 to 2; and z is an integer from 1 to 2.

20. The process of claim 19, wherein $R^{21}$ is an olefin polymer of $C_2$ to $C_{10}$ monoolefin having a number average molecular weight of about 300 to about 10,000.

21. The process of claim 20, wherein the olefin polymer has a number average molecular weight of about 700 to about 5,000.

22. The process of claim 21, wherein the number average molecular weight is from about 1,300 to about 3,000.

23. The process of claim 20, wherein the olefin polymer comprises polyisobutylene of about 700 to 5,000 number average molecular weight; the first nitrogen-containing compound comprises ammonia; the second nitrogen-containing compound comprises polyalkylenepolyamine, wherein each alkylene group contains from 2 to 6 carbon atoms and said polyalkylenepolyamine contains from 5 to about 9 nitrogen atoms per molecule; and the $\alpha$, $\beta$-unsaturated compound comprises at least one member selected from the group consisting of methyl acrylate, ethyl acrylate, propyl acrylate, butyl acrylate, methyl methacrylate, ethyl methacrylate, propyl methacrylate, and butyl methacrylate.

24. The process of claim 20, wherein the olefin polymer comprises polyisobutylene.

25. The process of claim 20, wherein the olefin polymer comprises ethylene-propylene copolymer.

26. The process of claim 18, wherein the second nitrogen-containing compound comprises at least one polyamine containing from 2 to 60 carbon atoms and from 2 to 12 nitrogen atoms per molecule.

27. The process of claim 26, wherein the polyamine comprises a polyalkylenepolyamine wherein each alkylene group contains from 2 to 6 carbons and the polyalkylenepolyamine contains from 5 to about 9 nitrogen atoms per molecule.

28. The process of claim 18, wherein the second nitrogen-containing compound comprises polyethylenepolyamine or polypropylenepolyamine.

29. The process of claim 18, which further comprises borating the dispersant additive to obtain a borated dispersant additive containing from about 0.05 to 2.0 weight percent boron.

30. The process of claim 18, wherein the second nitrogen-containing compound comprises a polyamine containing an average of at least 2 primary nitrogen atoms per molecule; the polyfunctional reactant comprises at least one $\alpha$, $\beta$-unsaturated compound; and the first nitrogen-containing compound; and the first nitrogen-containing compound and the $\alpha$, $\beta$-unsaturated compound are contacted in an amount of from about 1.1 to 3 moles of the $\alpha$, $\beta$-unsaturated compound per equivalent of the reactive nitrogen moieties in the first nitrogen-containing compound.

31. The process of claim 30, wherein the second nitrogen-containing reactant comprises a polyamine which contains an average of at least 2 primary nitrogen atoms per molecule; and the second adduct contains an average of from 2 to 6 unreacted primary amine groups per molecule.

32. The process of claim 30, wherein the first adduct is characterized by an average degree of branching of from 3 to 20.

33. The process of claim 31, wherein the amido-amine contains an average of from 1 to 3 amido groups per molecule of the amido-amine.

34. The process of claim 18, wherein contacting in the first reaction mixture is conducted at a temperature of about −10° C. to about 40° C. for a period of from about 2 to about 30 hours.

35. The process of claim 18, wherein contacting in the second reaction mixture is conducted at a temperature of from about 80° C. to about 150° C. for a period from about 2 to about 30 hours.

* * * * *